US012247444B2

(12) United States Patent
Slavens et al.

(10) Patent No.: US 12,247,444 B2
(45) Date of Patent: Mar. 11, 2025

(54) TORSIONAL DAMPING AND FLEXIBLE COMPONENTS IN DOWNHOLE SYSTEMS AND METHODS

(71) Applicant: Schlumberger Technology Corporation, Sugar Land, TX (US)

(72) Inventors: Sarah Slavens, Houston, TX (US); Scott Woolston, Spanish Fork, UT (US); Denis Li, Sugar Land, TX (US); Ebenezer Sola Oluwadare, Sugar Land, TX (US); Kien Hoe Tang, Calgary (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/360,448

(22) Filed: Jul. 27, 2023

(65) Prior Publication Data

US 2025/0034956 A1 Jan. 30, 2025

(51) Int. Cl.
*E21B 17/07* (2006.01)
*E21B 17/042* (2006.01)

(52) U.S. Cl.
CPC ..... *E21B 17/07* (2013.01); *E21B 17/042* (2013.01)

(58) Field of Classification Search
CPC ..... E21B 17/07; E21B 17/042; E21B 17/03
See application file for complete search history.

(56) References Cited

U.S. PATENT DOCUMENTS

| | | | | |
|---|---|---|---|---|
| 3,234,817 | A | 2/1966 | Williamson | |
| 3,641,839 | A | 2/1972 | Greeley | |
| 3,992,963 | A | 11/1976 | Khanna | |
| 4,262,553 | A | 4/1981 | Bremer, Jr. | |
| 4,522,271 | A | 6/1985 | Bodine et al. | |
| 6,364,039 | B1 * | 4/2002 | Majkovic | E21B 17/073 175/320 |
| 6,808,455 | B1 | 10/2004 | Solorenko et al. | |
| 7,036,612 | B1 | 5/2006 | Raymond et al. | |
| 7,216,726 | B2 | 5/2007 | Swietlik et al. | |
| 7,219,752 | B2 | 5/2007 | Wassell et al. | |
| 7,654,344 | B2 | 2/2010 | Haughom et al. | |
| 7,748,474 | B2 | 7/2010 | Watkins et al. | |
| 7,828,082 | B2 | 11/2010 | Pabon | |
| 7,984,771 | B2 | 7/2011 | Pabon | |
| 9,404,316 | B2 | 8/2016 | Gaji | |
| 9,476,261 | B2 | 10/2016 | Venugopal et al. | |
| 9,784,046 | B2 | 10/2017 | Gajji et al. | |
| 9,835,226 | B2 | 12/2017 | Son | |

(Continued)

FOREIGN PATENT DOCUMENTS

| | | | |
|---|---|---|---|
| WO | 2021202484 | A1 | 10/2021 |
| WO | 2023168380 | A1 | 9/2023 |

*Primary Examiner* — Brad Harcourt
(74) *Attorney, Agent, or Firm* — Bryan K. Adams

(57) ABSTRACT

A flexible downhole component includes an upper connection for connecting the flexible downhole component to a first downhole tool and a lower connection for connecting the flexible downhole component to a second downhole tool. The flexible downhole component includes a flexible body disposed between the upper connection and the lower connection. The flexible downhole component includes an upper damping component and a lower damping component each configured to damp torsional oscillations.

19 Claims, 14 Drawing Sheets

(56) References Cited

U.S. PATENT DOCUMENTS

| | | | | |
|---|---|---|---|---|
| 10,047,573 | B2 | 8/2018 | Kadam et al. | |
| 10,443,321 | B2 | 10/2019 | Cravatte et al. | |
| 10,533,376 | B2 | 1/2020 | Reimers | |
| 10,539,000 | B2 | 1/2020 | Hadi | |
| 10,837,497 | B2 | 11/2020 | Hauptmann et al. | |
| 11,136,834 | B2 | 10/2021 | Hohl et al. | |
| 11,142,962 | B2 | 10/2021 | Simanowski et al. | |
| 11,199,242 | B2 | 12/2021 | Hohl et al. | |
| 11,448,015 | B2 | 9/2022 | Hohl | |
| 2008/0066965 | A1* | 3/2008 | Pabon | E21B 17/07 267/137 |
| 2015/0259989 | A1* | 9/2015 | Gajji | E21B 19/24 175/56 |
| 2016/0053557 | A1 | 2/2016 | Whiteford et al. | |
| 2021/0079738 | A1 | 3/2021 | Peters et al. | |
| 2021/0079976 | A1 | 3/2021 | Peters | |
| 2021/0404268 | A1 | 12/2021 | Simanowski | |
| 2022/0403731 | A1 | 12/2022 | Johnson | |
| 2023/0160267 | A1* | 5/2023 | Falahati | E21B 47/017 464/20 |
| 2023/0407712 | A1* | 12/2023 | Reckmann | E21B 17/07 |

* cited by examiner

TORSIONAL DAMPING AND FLEXIBLE COMPONENTS IN DOWNHOLE SYSTEMS AND METHODS

CROSS-REFERENCE TO RELATED APPLICATIONS

N/A.

BACKGROUND

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores.

Downhole drilling systems may include one or more rotating components. During operation, the rotating components may perform a variety of operations, including power generation, drilling, reaming, casing cutting, milling, steering, and other rotary operations. When rotating, the components may experience various types of vibrations, including axial, lateral, and torsional vibrations. Vibrations or oscillations may fatigue components of downhole tools (e.g., housings, shafts, etc.), increase wear, decrease tool effectiveness, or otherwise damage downhole tools.

SUMMARY

In some embodiments, a flexible downhole component includes an upper connection for connecting the flexible downhole component to a first downhole tool and a lower connection for connecting the flexible downhole component to a second downhole tool. The flexible downhole component includes a flexible body disposed between the upper connection and the lower connection. The flexible downhole tool includes an upper damping component configured to damp torsional oscillations and a lower damping component configured to damp torsional oscillations.

In some embodiments, a flexible downhole system includes a flexible body and a first torsional damping component integrally joined to the flexible body. The first torsional damping component includes viscous inertial damping elements.

In some embodiments, a method of assembling a flexible downhole component includes connecting an upper damping component to an uphole end of a flexible body. The upper damping component is configured to mitigate a first mode of high frequency torsional oscillations (HFTO) of the flexible downhole component. The flexible body is configured to bend throughout a rotation of the flexible downhole component to facilitate a dogleg of a downhole tool connected to the flexible downhole component. The method includes connecting a lower damping component to a downhole end of the flexible body. The lower damping component is configured to mitigate a second mode of HFTO of the flexible downhole component.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 1-1 is a schematic view of a drilling system, according to at least one embodiment of the present disclosure;

FIGS. 2 and 2-1 are schematic representations of a flexible downhole component, according to at least one embodiment of the present disclosure;

FIG. 6-1 is a schematic representation of a flexible downhole tool, according to at least one embodiment of the present disclosure;

FIG. 6-2 is a schematic representation, including both an exploded view and an assembled view of a flexible downhole component with respect to an upper damping tool and a lower damping tool, according to at least one embodiment of the present disclosure;

FIG. 7-1 illustrates example vibration data, according to at least one embodiment of the present disclosure;

FIG. 7-2 illustrates example vibration data, according to at least one embodiment of the present disclosure;

FIG. 7-3 illustrates example vibration data, according to at least one embodiment of the present disclosure;

FIG. 7-4 illustrates example vibration data, according to at least one embodiment of the present disclosure.

DETAILED DESCRIPTION

Embodiments of the present disclosure relate to devices, systems, and methods for damping vibrations/oscillations in downhole tools. For instance, downhole systems may experience a variety of motions, vibrations, and oscillations. In some embodiments, the movements are associated with drilling activities. For example, one or more downhole tools may rotate to degrade a formation or other downhole materials. The downhole tools may include a rotating bit, mill, or reamer. The engagement of a downhole tool and/or drill string with downhole materials, the flow of drilling or production fluids against or through a downhole tool, or other conditions may cause vibrations, torsional oscillations, and other motions. For the purposes of this disclosure, the terms vibrations, oscillations, and other motions may be used interchangeably, unless otherwise stated, and may refer to vibrations in or exhibited by any component of a drilling system, such as axial vibrations, lateral vibrations, and torsional vibrations. In some embodiments, the vibrations are high frequency torsional oscillations (HFTO). Left unchecked, these torsional oscillations may damage, increase wear, or increase fatigue on one or more components of the downhole system, and combinations thereof. A damping component may be included in the downhole system to reduce the effect of the torsional oscillations. For example, a damping component may be included in one or more downhole tools. A damping component may reduce the amplitude and/or frequency of the torsional oscillations. Of course, vibrations and oscillations may be a concern in other downhole contexts apart from drilling (e.g., testing, perforating, production, artificial lift, etc.), and a downhole environment should not be limited to drilling systems.

Figure 1:
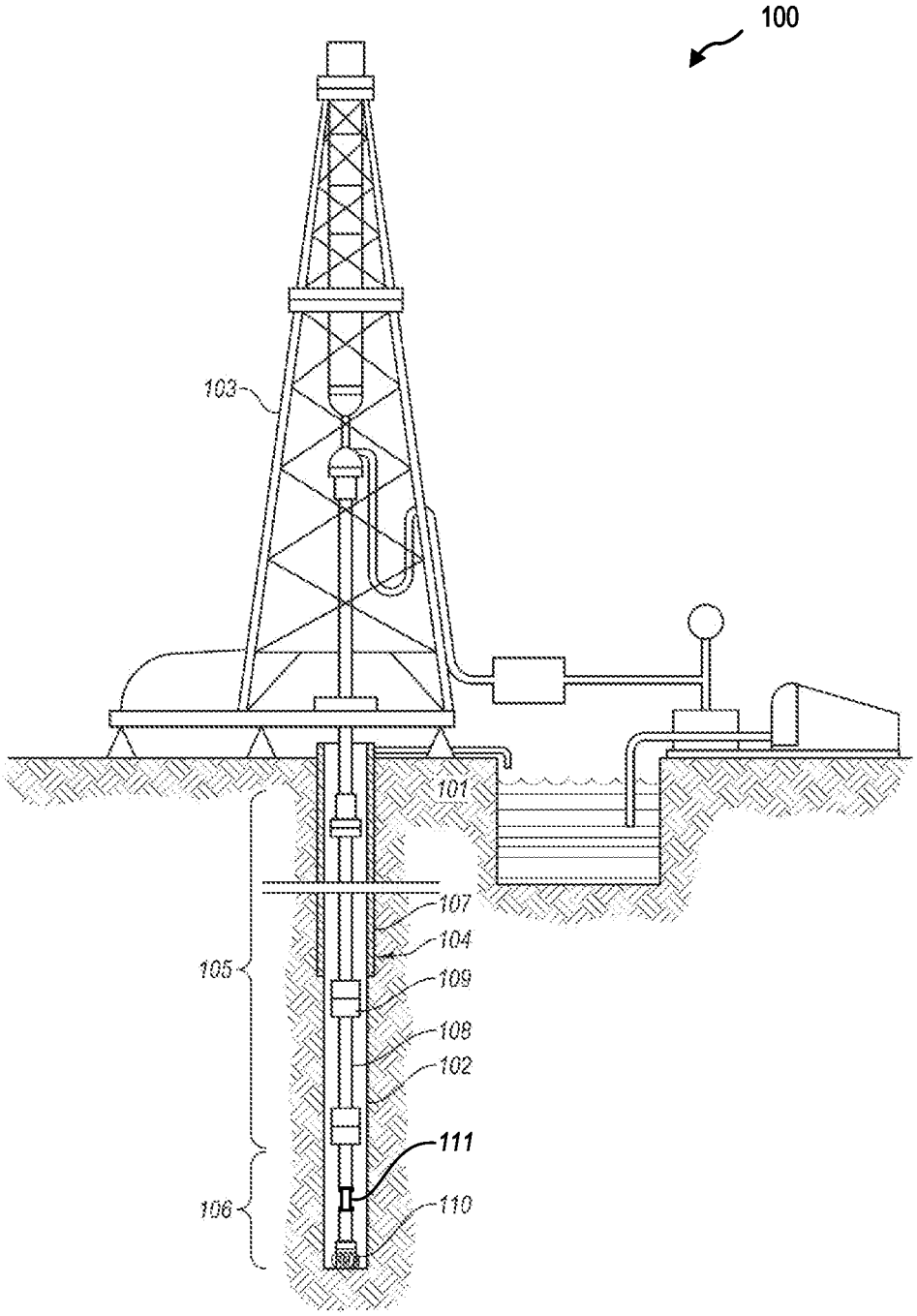
FIG. 1 is schematic view of a drilling system, according to at least one embodiment of the present disclosure.
Figure 1:
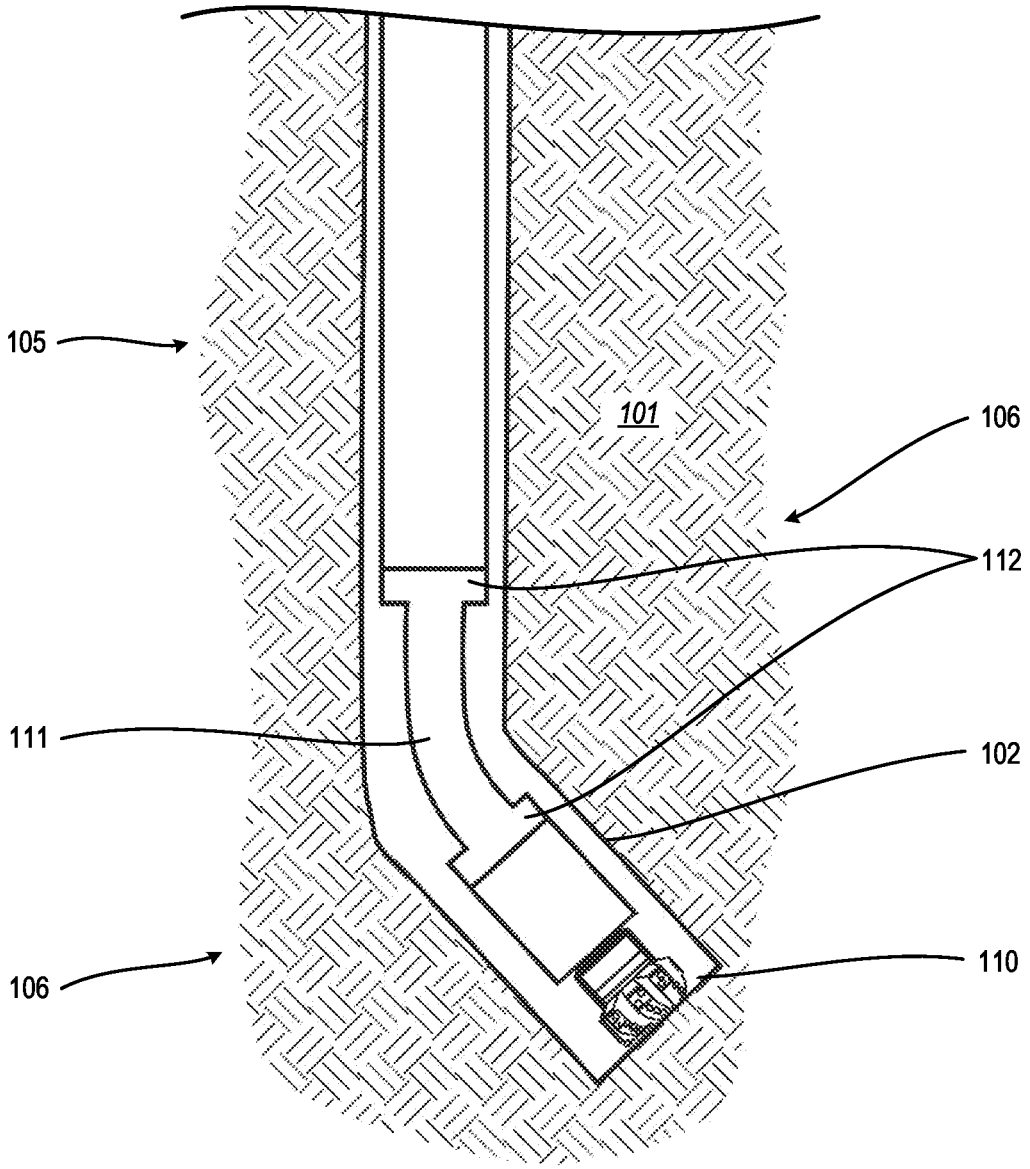

FIGS. 1 and 1-1 show one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly (BHA) 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 further includes additional components such as subs, pup joints, etc. The drill pipe 108 provides a hydraulic passage through which drilling fluid is pumped from the surface. The drilling fluid discharges through nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between the drill string 105 and the bit 110). Examples of additional BHA components include drill collars, stabilizers, measurement-while-drilling (MWD) tools, logging-while-drilling (LWD) tools, downhole motors, underreamers, section mills, hydraulic disconnects, jars, vibration or damping tools, other components, or combinations of the foregoing. The BHA 106 may further include a rotary steerable system (RSS). The RSS may include directional drilling tools that change a direction of the bit 110, and thereby the trajectory of the wellbore 102. In some cases, at least a portion of the RSS maintains a geostationary position relative to an absolute reference frame, such as gravity, magnetic north, or true north. Using measurements obtained with the geostationary position, the RSS may locate the bit 110, change the course of the bit 110, and direct the directional drilling tools on a projected trajectory.

In some embodiments, the drilling system 100 includes a flexible downhole component 111, such as a flex sub. The flexible downhole component 111 may facilitate steering of the BHA 106 and/or the bit 110. For example, as shown in FIG. 1-1, the flexible downhole component 111 may bend in order that a portion (or all) of the BHA 106 may advance through the earth formation 101 at an angle relative to another portion of the wellbore 102. The flexible downhole component 111 may bend in response to the RSS directing and/or biasing the bit 110 and/or the BHA 106 in a particular direction. As will be discussed herein, the flexible downhole component 111 may include one or more portions of a reduced diameter in order to facilitate the bending of the flexible downhole component 111. In many cases, an overall length of the BHA 106 may directly affect the ability to steer the BHA 106, or to achieve a dogleg of a certain degree. For example, a longer BHA 106 may reduce the ability to achieve a tight dogleg, or to direct the BHA 106 at a more acute angle. Thus, while the flexible downhole component 111 may bend to facilitate steering of the BHA 106, the overall length of the BHA 106 may affect how aggressive an angle may be achieved.

The flexible downhole component 111 is not limited to the embodiment just mentioned but may be any flexible component for facilitating the directional drilling of the bit 110 and/or the BHA 106 as described herein. Additionally, the flexible downhole component 111 is not limited to being included as part of the BHA 106 (or between the BHA 106 and the drill string 105) but may be included at any (or multiple) locations in the drilling tool assembly 104 of the drilling system 100.

In general, the drilling system 100 may include additional or other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

In some embodiments, a downhole motor in the BHA 106 generates power for downhole systems and/or provide rotational energy for downhole components (e.g., rotate the bit 110). The downhole motor may be any type of downhole motor, including a positive displacement pump (such as a progressive cavity motor) or a turbine. In some embodiments, the downhole motor is powered by the drilling fluid. In other words, the drilling fluid pumped downhole from the surface may provide the energy to rotate a rotor in the downhole motor. The downhole motor may operate with an optimal pressure differential or pressure differential range. The optimal pressure differential may be the pressure differential at which the downhole motor may not stall, burn out, overspin, or otherwise be damaged. In some cases, the downhole motor drives the rotation of the bit. In some embodiments, the rotation of the bit is driven by a component at the surface of the wellbore 102.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits, and roller cone bits. In other embodiments, the bit 110 may be a mill used for removing metal, composite, elastomer, other downhole materials, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface or may be allowed to fall downhole. In still other embodiments, the bit 110 may include a reamer. For instance, an underreamer may be used in connection with a drill bit and the drill bit may bore into the formation while the underreamer enlarges the size of the bore.

Rotating the drill string 105 and/or operation of the downhole motor may wholly or partially cause oscillations in the drilling tool assembly 104 (e.g., in drill string 105 and/or the BHA 106). The oscillations can have various effects. For instance, the oscillations may be generated by energy input into the system, which may essentially rob energy from being input into the bit 110, reducing the efficient transfer of energy to the bit. The vibrations/oscillations may also damage one or more components of the drilling system 100, such as one or more components of the BHA 106. In some embodiments, the oscillations are associated with the flexible downhole component 111. For example, the oscillations may be at least partially due to or caused by the flexible downhole component 111 (e.g., the flexible nature of the flexible downhole component 111 may cause a torsional imbalance or mismatch with other portions of the BHA 106 resulting in vibrations). In another example, the oscillations (e.g., a significant or peak amplitude of the oscillations) may be exhibited at or near the flexible downhole component 111 (such as above and/or below the flexible downhole component 111). Thus, while the flexible downhole component 111 may be important or even essential for desired steering of the BHA 106, implementing the flexible downhole component 111 may result in HFTO that may damage, wear, fatigue, etc. one or more components of the downhole system.

In some embodiments, the drilling system 100 includes one or more damping components 112. The damping components 112 may at least partially damp the oscillations. The damping components 112 may be positioned on the flexible downhole component. For example, the damping components 112 may be included as part of the flexible downhole component 111. One or more of the damping components 112 may be positioned on an uphole and/or a downhole end of the flexible downhole component 111. Using the damping components 112 to reduce the oscillations in the drilling tool assembly 104 (e.g., in the BHA 106) may reduce damage to components of the BHA 106 and/or more efficiently transfer power/energy to the bit 110. In this way, the damping components 112 may help to increase system efficiency, reduce downtime, and decrease costs. Thus, it may be advantageous to include one or more of the damping components 112 in the downhole system. However, as mentioned above, the length of the BHA 106 may directly affect the ability to steer or achieve a dogleg of the BHA 106. Thus, while it may be important to reduce and/or mitigate vibrations, it may be critical to include the damping components 112 in a manner that does not increase the overall length of the BHA 106 in order that steering/dogleg are not adversely affected.

Figure 2:
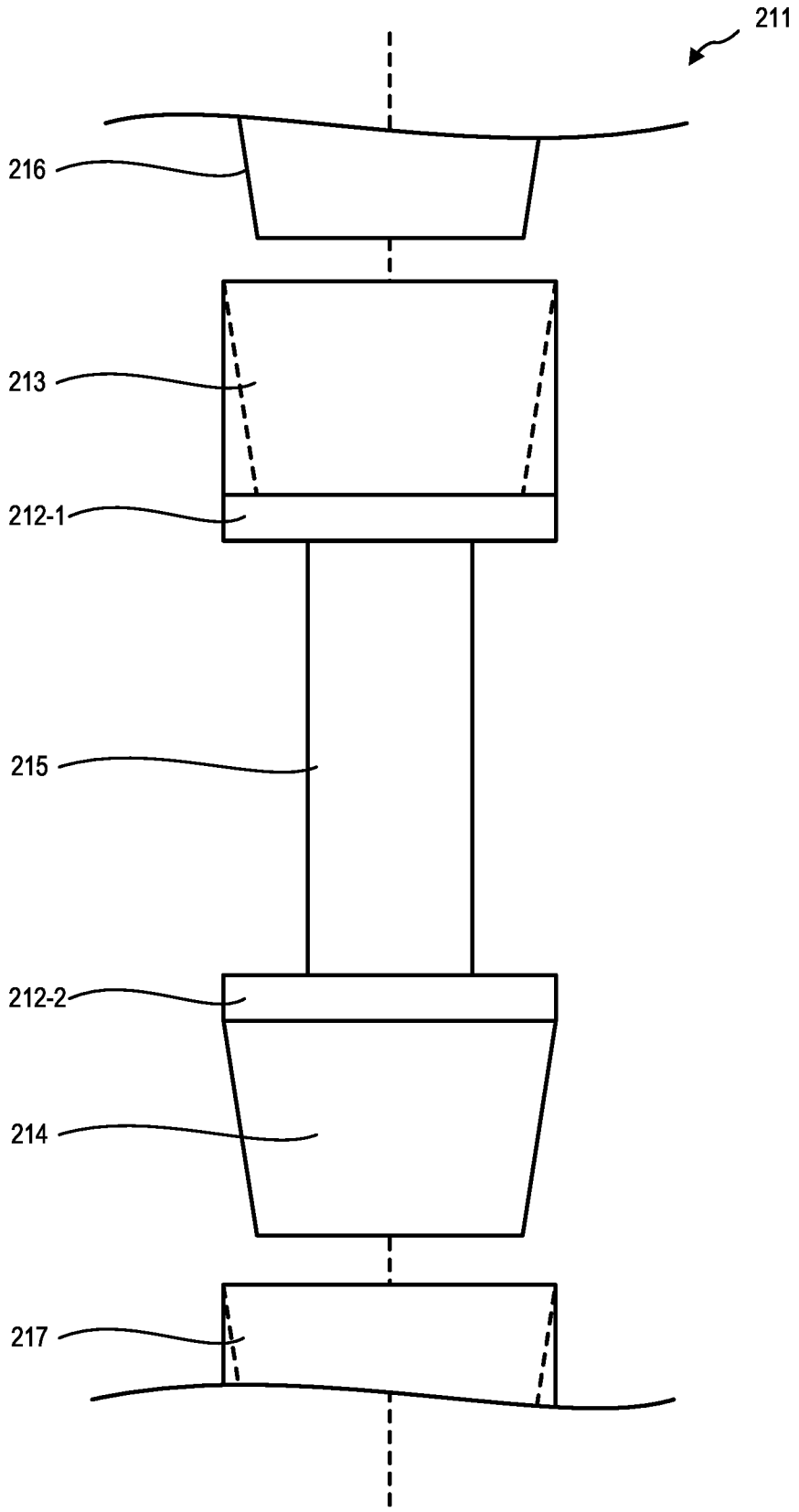
Figures 1, 2:
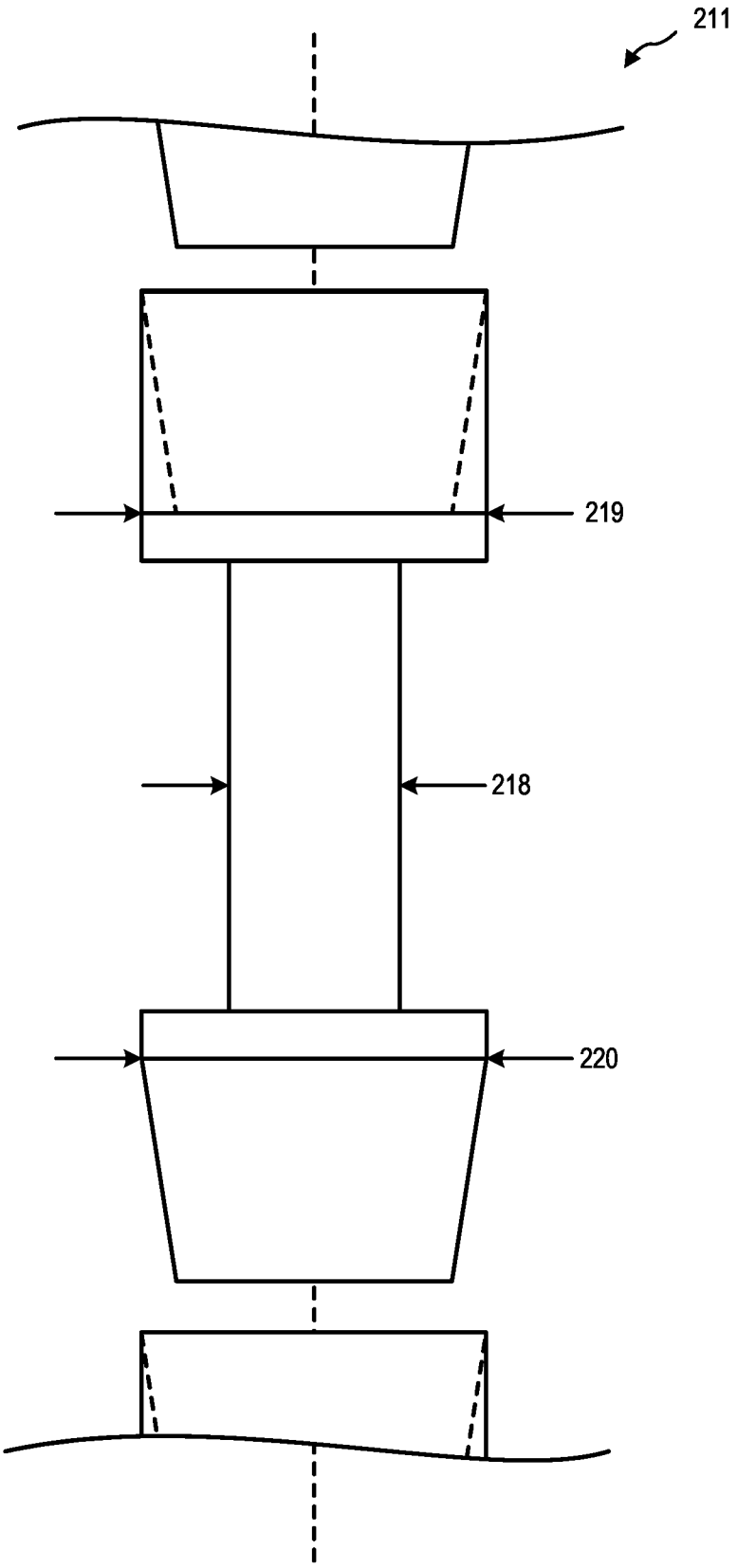

FIGS. 2 and 2-1 are schematic representations of a flexible downhole component 211, according to at least one embodiment of the present disclosure. The flexible downhole component 211 may be included as part of a drilling tool assembly, such as part of a BHA (or at any other location) in a downhole drilling system.

In some embodiments, the flexible downhole component 211 includes an upper connection 213 and a lower connection 214. The upper connection 213 and lower connection 214 may each be connections for joining the flexible downhole component 211 to a portion of the drilling tool assembly. For example, the upper connection 213 may join the flexible downhole component 211 to a first downhole tool 216. The lower connection 214 may join the flexible downhole component 211 to a second downhole tool 217. For example, the first downhole tool 216 and the second downhole tool 217 may each be one or more of a drill pipe, sub, bit, reamer, stabilizer, RSS, motor, LWD tool, MWD tool, tool joint, any other component of a BHA, drill string, or drilling tool assembly as described herein, and combinations thereof. The flexible downhole component 211 may be implemented in a downhole system associated with the forming, drilling, or widening of a 6¼ in., 8½ in., 9 in., or 12 in. borehole, or any value therebetween.

In some embodiments, the upper connection 213 and the lower connection 214 are threaded connections, or are joined to the first downhole tool 216 and the second downhole tool 217 (respectively) with threaded connections. In some embodiments, the upper connection 213 and/or the lower connection 214 are pin connections for threading into a box connection of a corresponding downhole tool. In some embodiments, the upper connection 213 and/or the lower connection 214 are box connections for threading into a pin connection of a corresponding downhole tool. For example, in some embodiments the upper connection 213 and the lower connection 214 may both be box connections. In another example, the upper connection 213 and the lower connection 214 may both be pin connections. In accordance with at least one embodiment of the present disclosure, the upper connection 213 is a box connection and the lower connection 214 is a pin connection, as shown in FIG. 2. In this way, the flexible downhole component 211 may join to various components of a downhole system while, for example, including one or more dampers for damping vibrations, as described below.

In some embodiments, the flexible downhole component 211 includes a flexible body 215. The flexible body 215 may be disposed between the upper connection 213 and the lower connection 214. The flexible body 215 may be integral with or joined to the upper connection 213 and the lower connection 214. In this way, one or more downhole tools positioned further uphole and one or more downhole tools positioned further downhole of the flexible body 215 may be joined through the flexible body 215. For example, the first downhole tool 216 may be a drill string and the second downhole tool 217 may be a BHA. In this way, the flexible downhole component 211 may join the BHA to the drill string. In accordance with at least one embodiment of the present disclosure, the flexible downhole component 211 may be included as part of a BHA of a downhole system. The BHA may include one or more engagement tools such as a bit, as well as one or more drive and steering tools that may drive a rotation and a relative deflection of the bit. The flexible downhole component 211 may be positioned in the BHA in order to facilitate the steering components directing the bit at a desired angle in order to facilitate steering of the downhole system.

The flexible body 215 may bend (i.e., flex) throughout a rotation of the flexible downhole component 211. The bending of the flexible body 215 may facilitate the positioning and/or the directing of one or more downhole components of a drilling system at an angle relative to one or more other downhole components. For example, the flexible body 215 may bend and may allow the second downhole tool 217 to extend in a direction at an angle relative to the first downhole tool 216 (such as that shown in FIG. 1-1). The flexible body 215 may bend in this manner during or while the flexible downhole component 211 is rotating, and in this way, the flexible body 215 may facilitate, for example, steering one or more downhole components during downhole drilling operations.

In some embodiments, the flexible nature of the flexible body 215 is based on a different (e.g., reduced) stiffness of the flexible body 215 with respect to other downhole components. For example, the flexible body 215 may have a flexible body stiffness. The upper connection 213 (and/or any other component uphole of the flexible body 215) may have an upper connection stiffness. The lower connection 214 (and/or any other component downhole of the flexible body 215) may have a lower connection stiffness. The flexible body stiffness may be less than the upper connection stiffness and/or the lower connection stiffness. This may allow or may facilitate the flexible downhole component 211 bending more than one or more other components such as the upper connection 213 and/or the lower connection 214 in the manner described herein. The flexible body stiffness, the upper connection stiffness, and the lower connection stiffness may each refer to a stiffness (of the respective components) with respect to bending (e.g., a bending moment) or with respect to torsional loading, or both. For example, while the flexible body may exhibit a flexible body stiffness to allow the flexible body 215 to bend while rotating, the flexible body may also (or as a result) exhibit a torsional stiffness that is less than a torsional stiffness of the upper connection 213, the lower connection 214, and/or any other downhole component. This reduced torsional aspect of the flexible body stiffness may be associated with (and/or may cause) vibrations such as HFTO in one or more components of the drilling system, as will be described herein in detail.

In some embodiments, the flexible body stiffness is based on a dimension of the flexible body 215. For example, the flexible body 215 may have a substantially round dimension or may be substantially cylindrical. As shown in FIG. 2-1, the flexible body 215 may have a flexible body diameter 218. The upper connection 213 may have an upper connection diameter 219 and the lower connection may have a lower connection diameter 220. The upper connection diameter 219 and the lower connection diameter 220 may each be a measure of a diameter at a widest point of the upper connection 213 and the lower connection 214, respectively. In some embodiments, the upper connection diameter 219 corresponds to a diameter of the first downhole tool 216 (or any other component uphole of the flexible body 215), and the lower connection diameter 220 corresponds to a diameter of the second downhole tool 217 (or any other component downhole of the flexible body 215). The upper connection diameter 219 and the lower connection diameter 220 may be the same or they may be different. The flexible body diameter 218 may be less than the upper connection diameter 219 and/or the lower connection diameter 220. The flexible body diameter 218 being reduced in this way may facilitate the flexible body 215 bending (e.g., through a rotation of the flexible downhole component 211) in the manner described herein.

In some embodiments, at least a portion of the flexible body 215 is made of the same material as the upper connection 213 and the lower connection 214. This may facilitate integrally forming the flexible downhole component 211 as single body, as described herein. In some embodiments, at least a portion of the flexible body 215 is made of a different material than the upper connection 213 and the lower connection 214. In some embodiments, the flexible body 215 is made of steel such as low-alloy steel, or stainless steel. In this way the flexible downhole component 211 may include the flexible body 215 to facilitate steering and/or directing one or more downhole tools at an angle relative to other portions of the drilling tool assembly.

In some embodiments, the flexible downhole component 211 includes one or more damping components for damping vibrations such as HFTO. The flexible downhole component 211 may include an upper damping component 212-1. The flexible downhole component 211 may include a lower damping component 212-2. The upper damping component 212-1 and the lower damping component 212-2 may each damp vibrations (e.g., HFTO) experienced and/or exhibited by the flexible downhole component 211 and/or any other downhole component. For example, the upper damping component 212-1 and the lower damping component 212-2 may damp the same or different modes present in the HFTO. The upper damping component 212-1 and the lower damping component 212-2 may each damp torsional oscillations of the attached BHA.

The upper damping component 212-1 and/or the lower damping component 212-2 (together, damping components 212) may be inertial damping components. For example, the damping components 212 may include a damper body. One or more inertial elements may be disposed within the damper body. The one or more inertial elements may be at least partially suspended in the damper body by damping features. Damping features may include a fluid, biasing elements, or any combination thereof. Forces on the damper body, such as due to vibrations like HFTO, may be transferred to the one or more inertial elements therein by the damping features. The one or more inertial elements resist changes in motion transferred through the damping features. At least some of the energy from the movement (e.g., vibrations) of the damper body may be dissipated to or through transfer to the inertial element via the damping features. For example, vibration energy transferred to the damping components 212 may heat the damping features and the one or more inertial elements of the damping components 212. In this way the damping components 212 (e.g., based on the inertial element) may damp vibrations in the drilling tool assembly.

It should be understood that the damping components 212 are not limited to the damping techniques just mentioned. Rather, the damping components 212 may be any components for the dissipation of mechanical energy from a vibrating structure and/or the removal of mechanical energy (e.g., vibrations) from the system. For example, the damping components 212 may include one or more components that operate based on the principles of viscous damping, Coulomb or dry friction damping, structural damping, material or hysteretic damping, slip or interfacial damping, magnetic damping, any other form or principle of damping, and combinations thereof. Non-limiting examples and implementations of the damping component 212 for damping vibrations experienced by one or more downhole tools can be found in US Patent Application No. US2023/0142360, which is hereby incorporated by reference in its entirety. In accordance with at least one embodiment of the present disclosure, the damping components 212 may facilitate damping torsional vibrations such as HFTO.

In some embodiments, the upper damping component 212-1 is positioned at an uphole portion of the flexible body 215. For example, the upper damping component 212-1 may be located at the upper connection 213 (e.g., but not threaded into the upper connection 213). The upper damping component 212-1 may be joined to the flexible body 215 at an uphole end of the flexible body 215. In some embodiments, the lower damping component 212-2 is positioned at a downhole portion of the flexible body 215. For example, the lower damping component 212-2 may be located at the lower connection 214 (e.g., but not threaded into the lower connection 214). The lower damping component 212-2 may be joined to the flexible body 215 at a downhole end of the flexible body 215. The inclusion and positioning of the upper damping component 212-1 and/or the lower damping component 212-2 above and/or below the flexible body 215 in this way may facilitate damping and/or mitigating one or more modes of HFTO, as will be described herein (e.g., in connection with FIG. 7). The upper damping component 212-1 and the lower damping component 212-2 being included within or as part of the flexible downhole component 211 may also help to maintain a shorter overall length of the flexible downhole component 211 and/or BHA. This may be in contrast to connecting separate damping components to a flexible downhole component which may result in added length to the BHA. As mentioned above, this shorter length may facilitate operating the BHA at a tighter dogleg (e.g., as described in connection with FIGS. 6-1 and 6-2).

Figure 3:
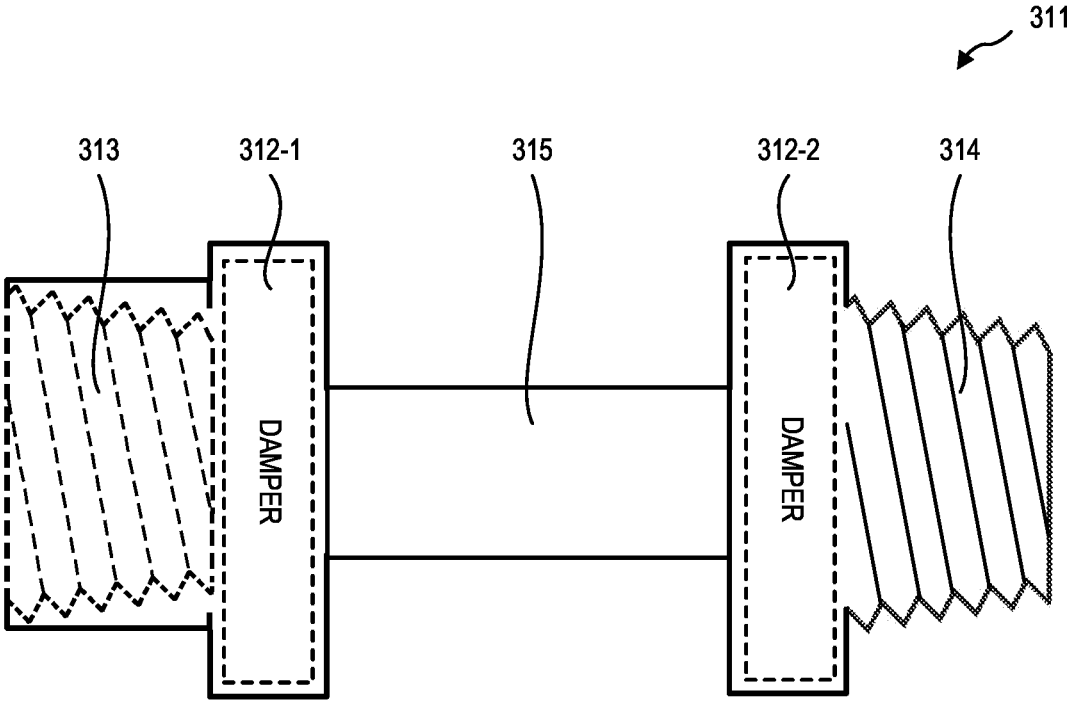
FIG. 3 is a schematic representation of a flexible downhole component, according to at least one embodiment of the present disclosure.

FIG. 3 is a schematic representation of a flexible downhole component 311, according to at least one embodiment of the present disclosure. The flexible downhole component 311 may include a flexible body 315, an upper connection 313, and a lower connection 314. The flexible downhole component 311 may include an upper damping component 312-1, a lower damping component 312-2, or both.

In some embodiments, the flexible downhole component 311 is made of one body. The upper connection 313, the upper damping component 312-1, the flexible body 315, the lower damping component 312-2, and the lower connection 314 may all be integrally formed. For example, the upper damping component 312-1 and the lower damping component 312-2 may each include a damper housing with one or more separate damping components positioned within the damping housing. The damping housings of each of the upper damping components 312-1 and the lower damping component 312-2 may be integrally formed with the upper connection 312-1, the lower connection 314, and the flexible body. These components may all be integrally formed by being machined from the same piece of material, or by being cast as one unitary body. The integrally formed flexible downhole component 311 may include a body portion of each of the upper damping component 312-1 and the lower damping component 312-2, and the damping mechanisms of each damping component may be contained and/or may be operable within the body portion. The flexible downhole component 311 being integrally formed in this way may facilitate implementation of the flexible downhole component 311 in a downhole system, for example, without requiring any assembly after manufacturing or at the drill site. Including the upper damping component 312-1 and the lower damping component 312-2 in the integral body of the flexible downhole component 311 may also facilitate implementing these components in the downhole system while, for example, maintaining a shorter length of the flexible downhole component 311 and/or the BHA (e.g., as described herein in connection with FIGS. 6-1 and 6-2).

Figure 4:
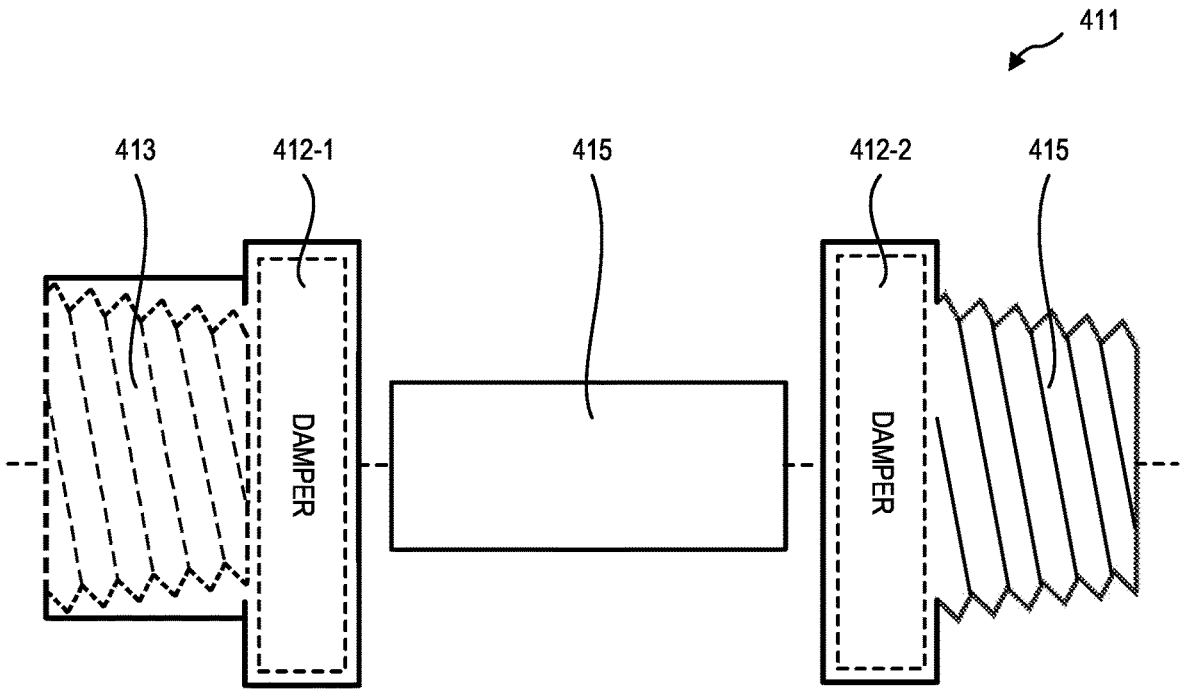
FIG. 4 is an exploded schematic representation of a flexible downhole component, according to at least one embodiment of the present disclosure.

FIG. 4 is a, exploded schematic representation of a flexible downhole component 411, according to at least one embodiment of the present disclosure. The flexible downhole component 411 may include a flexible body 415, an upper connection 413, and a lower connection 414. The flexible downhole component 411 may include an upper damping component 412-1, a lower damping component 412-2, or both.

In some embodiments, the flexible downhole component 411 is an assembly. For example, two or more components, when assembled, may form the flexible downhole component 411. In some embodiments, one or more of the upper connection 413, the upper damping component 412-1, the lower damping component 412-2, and the lower connection 414 are separate and/or independent of the flexible body 415, and are assembled with the flexible body 415 to form the flexible downhole component 411.

According to at least one embodiment of the present disclosure, the upper connection 413 and the upper damping component 412-1 may be joined as one body (e.g., integrally formed). Put another way, the upper damping component 412-1 may include the upper connection 413. The upper damping component 412-1 and the upper connection 413 may be assembled with the flexible body 415. For example, these components may be joined to the flexible body 415 with a threaded connection, a bolted connection, a welded connection, or any other suitable connection (and combinations thereof) for joining the upper damping component 412-1 and the upper connection 413 to the flexible body 415. Similarly, the lower connection 414 and the lower damping component 412-2 may be joined as one body (e.g., integrally formed) and joined with the flexible body 415.

In some embodiments, the upper damping component 412-1 and the upper connection 413 are separate and/or independent bodies (e.g., not integrally formed). For example, the upper damping component 412-1 and the upper connection 413 may each separately join to the flexible body 415. In another example, the upper damping component 412-1 and the upper connection 413 may join to each other prior to and/or in order to join these components to the flexible body 415. The connection of the upper damping component 412-1 with the upper connection 413 (and/or the connection of these components with the flexible body 415) may be a threaded connection, a bolted connection, a welded connection, or any other suitable connection (and combinations thereof) for joining these components as described herein. In this way, the upper damping component 412-1 and the upper connection 413 may be joined with the flexible body 415 in the same position and/or orientation as that described above, but each component may be a separate body and/or may be separately joinable with the other components. In some embodiments the lower damping component 412-2 and the lower connection 414 are separate and/or independent bodies, and it should be appreciated that the techniques just described similarly apply to a connection of the lower damping component 412-2 with the lower connection 414 (and/or the connection of these components with the flexible body 415).

The components of the flexible downhole component 411 may be assembled and/or joined as a part of the manufacturing of the flexible downhole component 411. The components of the flexible downhole component 411 may be assembled and/or joined after manufacturing, such as at a drilling site, or prior to arriving at a drilling site. In this way, one or more components or parts of the flexible downhole component 411 may be modular and/or the flexible downhole component 411 may be an assembly. This may facilitate, for example, including the damping components within an existing flexible body 415, such as part of a retrofit. It should be appreciated that, while the flexible downhole component 411 described in FIG. 4 may be an assembly and may be assembled with threaded connections, for example, the techniques just mentioned are consistent with that described herein for including the damping components as part of or within the flexible downhole component 411 (e.g., without increasing the length). This may be in contrast to, for example, joining one or more damping components to an existing or conventional flexible downhole component (e.g., at an upper and/or lower tool connection) and thereby resulting in an overall longer assembly of components. The length savings that may be achieved by incorporating the flexible downhole component of the present disclosure in comparison are discussed in detail below in connection with FIGS. 6-1 and 6-2. In this way, the flexible downhole component 411 may achieve the length goals and/or requirements of the flexible downhole component 411 and/or the BHA as described herein (e.g., in connection with FIGS. 6-1 and 6-2).

Figure 5:
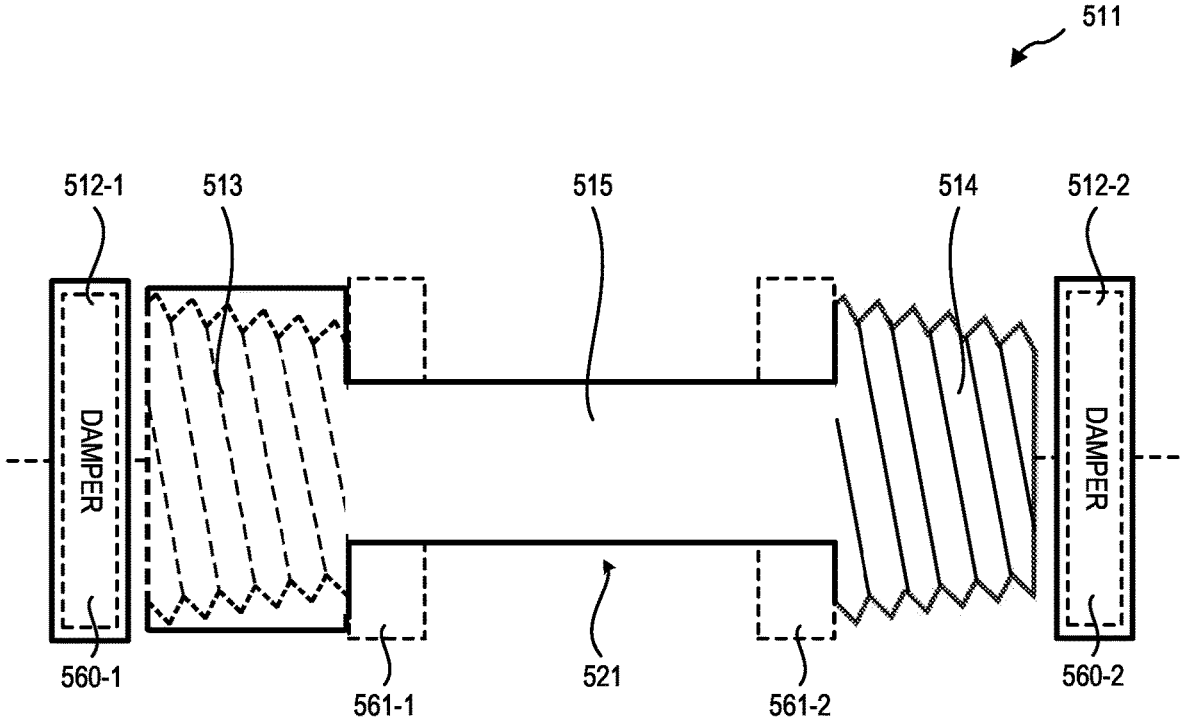
FIG. 5 is an exploded schematic representation of a flexible downhole component, according to at least one embodiment of the present disclosure.

FIG. 5 is an exploded schematic representation of a flexible downhole component 511, according to at least one embodiment of the present disclosure. The flexible downhole component 511 may include a flexible body 515, an upper connection 513, and a lower connection 514. The flexible downhole component 511 may include an upper damping component 512-1, a lower damping component 512-2, or both.

In some embodiments, the flexible downhole component 511 is an assembly. For example, two or more components, when assembled, may form the flexible downhole component 511. According to at least one embodiment of the present disclosure, the upper connection 513, the lower connection 514, and the flexible body 515 may be formed together as one integral body 521. For example, these components may all be machined from the same piece of material, or they may all be cast as one unitary body. In some embodiments, the upper damping component 512-1 and/or the lower damping component 512-2 (together, damping components 512) are separate and/or independent bodies from the integral body 521. The damping components 512 may each join to the integral body 521. For example, the upper damping component 512-1 and the lower damping component 512-2 are each shown in FIG. 5 is an exploded or pre-assembled position 560-1 and 560-2, respectively. The damping components 512 may each join to the integral body 521 at the assembled positions 561-1 and 561-2, respectively. In some embodiments, the damping components 512 may be hollow or may have an inner bore such that they may pass over the connections on the integral body 521. In another example, the damping components 512 may have one or more split or open features (or the damping components 512 may each be two or more pieces) such that they may fit and/or close around an outer diameter of the flexible body 515. The damping components 512 may join to the integral body 521, for example, by a threaded connection, welded connection, bolted connection, any other suitable connection, and combinations thereof. In this way, the damping components 512 may be positioned on the flexible downhole component 511 in accordance with that described herein.

The components of the flexible downhole component 511 may be assembled and/or joined as a part of the manufacturing of the flexible downhole component 511. The components of the flexible downhole component 511 may be assembled and/or joined after manufacturing, such as at a drilling site, or prior to arriving at a drilling site. In this way, one or more components or parts of the flexible downhole component 511 may be modular and/or the flexible downhole component 511 may be an assembly. In some embodiments, the damping components 512 are included within an existing flexible downhole tool, such as part of a retrofit. Including the damping components 512 in the flexible downhole component 511 in the manner described herein in this way may facilitate providing the damping effects of the damping components while achieving the length goals and/or requirements of the flexible downhole component 511 and/or the BHA as described herein (e.g., in connection with FIGS. 6-1 and 6-2).

Figures 1, 6:
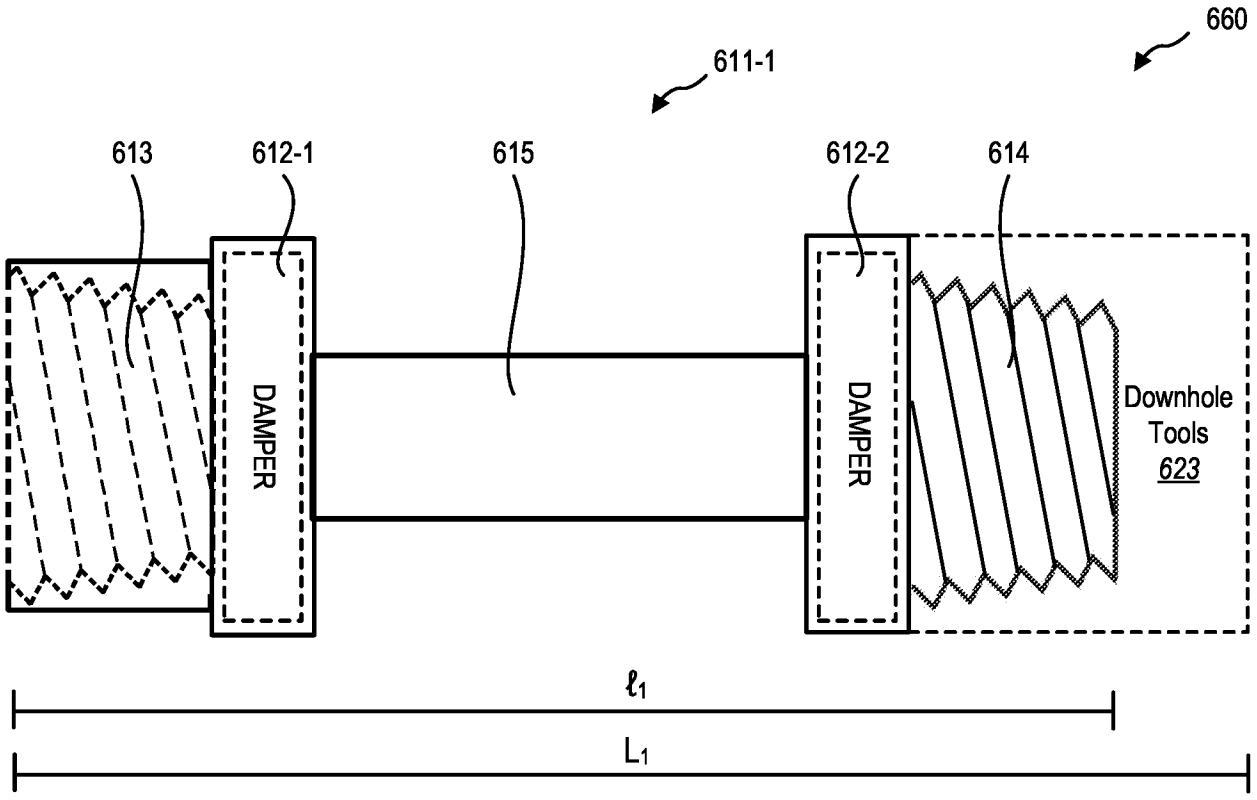
Figures 2, 6:
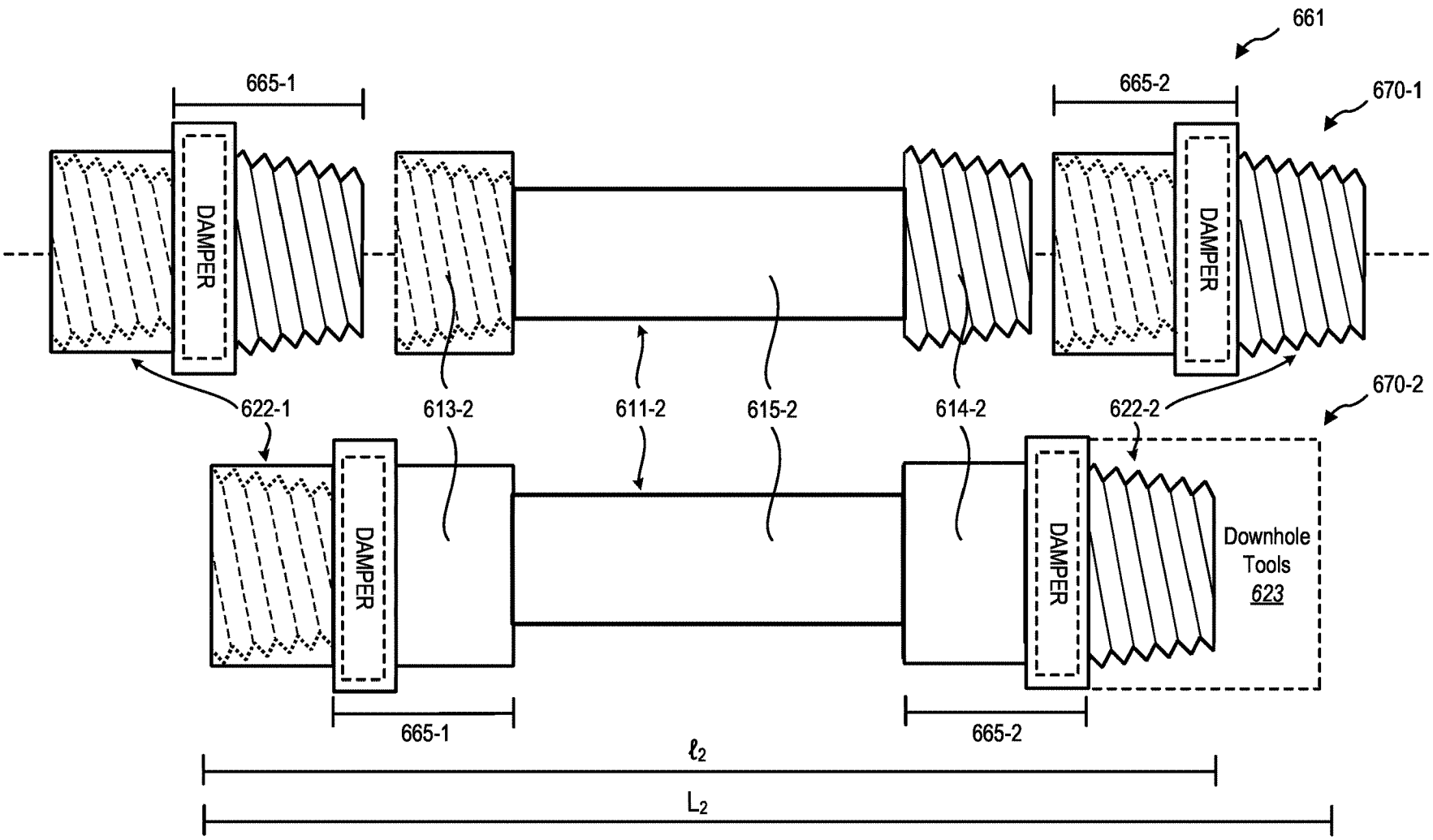

FIG. 6-1 is a schematic representation of a downhole assembly 660 including a flexible downhole component 611-1, according to at least one embodiment of the present disclosure. The flexible downhole component 611-1 may include a flexible body 615, an upper connection 613, and a lower connection 614. The flexible downhole component 611-1 may include an upper damping component 612-1, a lower damping component 612-2, or both. The upper damping component 612-1 may be positioned or located at the upper connection 613 and/or the lower damping component 612-2 may be positioned or located at the lower connection 614. For example, the upper damping component 612-1 and/or the lower damping component 612-2 may be positioned between the upper connection 613 and the lower connection 614. In this way, the damping components may be included within or as part of the flexible downhole component 611-1. The flexible downhole component 611-1 may join to one or more downhole tools 623 to form the downhole assembly 661. FIG. 6-1 will be discussed together with FIG. 6-2.

FIG. 6-2 is a schematic representation of a downhole assembly 661. The downhole assembly is comprised of a flexible assembly 670 joined to one or more downhole tools 623. FIG. 6-2 shows the flexible assembly 670 as both an exploded view 670-1 and an assembled view 670-2. The flexible assembly 670 includes flexible downhole component 611-2, an upper damping tool 622-1, and a lower damping tool 622-2, according to at least one embodiment of the present disclosure. The flexible downhole component 611-2 may include a flexible body 615-2, an upper connection 613-2 and a lower connection 614-2, each connected to the flexible body 615-2. Damping components may not be included as part of the flexible downhole component 611-2 (such as damping components 612-1 and 612-2 of FIG. 6-1). Rather, an upper damping tool 622-1 and/or a lower damping tool 622-2 (together, damping tools 622) may join or attach to the flexible downhole component 611-2, for example, by joining to the upper connection 613-2 and/or the lower connection 614-2. The damping tools 622 may each include their own connections similar to the upper and lower connections 613-2 and 614-2. In this way, the flexible downhole component 611-2 may join to additional tools and/or portions of the drilling tool assembly through the damping tools 622, or through a connection with the damping tools 622. For example, as shown in FIG. 6-2, the flexible assembly 670 may join to the downhole tools 623 to form the downhole assembly 661. The downhole tools 623 may be the same downhole tools 623 of FIG. 6-1 including the same quantity and arrangement of downhole tools. In this way, the downhole assembly 660 of FIG. 6-1 may illustrate an alternative technique to the conventional downhole assembly 661 of FIG. 6-2 for implementing one or more damping devices in connection with a flexible downhole component.

As described herein, a flexible downhole component (such as 611-1 or 611-2) may be included, for example, in a BHA in order to facilitate steering, or directing the BHA in an angled direction (e.g., a dogleg). To accomplish this, the flexible body 615 may bend while the BHA rotates. Doglegs in this way may be for a variety of purposes. For example, in some situations, geological targets may not be located directly beneath the drilling rig, and the BHA may be directed toward the target. Doglegs may also be used to navigate around geological obstacles or to adjust the wellbore trajectory to optimize hydrocarbon recovery.

The angle of a dogleg, or the degree to which the trajectory of the wellbore may be changed, may be related (either directly or in part) to a length of the BHA. For example, a shorter BHA may be able to perform or produce a tighter dogleg than a longer BHA. For this purpose, it may be critical to keep the BHA within a threshold length to ensure that adequate steering measures may be taken as needed.

The flexible downhole component 611-1 of FIG. 6-1 may have an overall length $l_1$. For example, the length $l_1$ may be measured from an uphole end to a downhole end of the flexible downhole component 611-1, or from the upper connection 613 to the lower connection 614. As described herein, the flexible downhole component 611-1 may include one or more damping components 612 (e.g., an upper damping component 612-1 and/or a lower damping component 612-2) as part of or within the flexible downhole component 611-1. For example, the damping components 612 may be located or positioned at or between upper and lower connections 613 and 614 of the flexible downhole component 611-1. In this way, an overall length $l_1$ of the flexible downhole component 611-1 may not be affected by, for example, the addition of the damping components 612. This may be in contrast to, for example, an overall length $l_2$ associated with the flexible assembly 661 in FIG. 6-2 (including the flexible downhole component 611-2 joined to upper and/or lower damping tools 622-1 and 622-2). For example, the length $l_2$ may include the length $l_1$ plus additional lengths 665-1 and 665-2 associated with attaching the upper damping tool 622-1 and the lower damping tool 622-2. In some embodiments, the length $l_1$ is lengthened by the inclusion of the damping components 612 but is lengthened to a lesser degree than the inclusion of the damping tools 622 such that the length $l_1$ is still less than the length $l_2$. In this way, $l_2$ may be greater than $l_1$, or the flexible assembly of FIG. 6-2 may result in a greater overall length than the flexible downhole component 611-1 of FIG. 6-1.

As shown in FIG. 6-1, the flexible downhole component 611-1 may be joined to the downhole tools 623 to form a downhole assembly 660. A corresponding downhole assembly length $L_1$ may according be directly dependent on or affected by the length $l_1$. In other words, a longer length $l_1$ results in a longer downhole assembly length $L_1$, and a shorter length $l_1$ results in a shorter downhole assembly length $L_1$. Similarly, the downhole assembly 661 in FIG. 6-2 may be joined to the same downhole tools 623 (e.g., as an alternative to the flexible downhole component 611-1 of FIG. 6-1 being joined to the downhole tools 623). A corresponding downhole assembly length $L_2$ may accordingly be directly dependent on or affected by the length $l_2$. Because the length 12 is greater than the length $l_1$, the downhole assembly length $L_2$ is accordingly greater than the downhole assembly length $L_1$. In other words, the flexible assembly 670 of FIG. 6-2 may result in an overall longer downhole assembly. This longer downhole assembly length may reduce the bending capacity of an associated BHA, and thus it may be advantageous to implement the flexible downhole component 611-1 in order to achieve a shorter downhole assembly length.

In some embodiments, the downhole assembly length $L_1$ is in a range having an upper value, a lower value, or upper and lower values including any of 12 ft, 14 ft, 16 ft, 18 ft, 20 ft, 22 ft, 24 ft, 26 ft, 28 ft, 30 ft, or any value therebetween. For example, the downhole assembly length $L_1$ may be less than 30 ft. In another example, the downhole assembly length $L_1$ may be greater than 12 ft. In yet another example, the downhole assembly length may be between 12 ft and 30 ft. In some embodiments, it is critical that the downhole assembly length $L_1$ be no greater than 20 feet, in order to provide the dogleg and/or steering benefits to the BHA as described herein.

As discussed herein generally, a drilling tool assembly includes any number of drilling tools joined through a variety of connections. For example, the drill string may include many lengths of drill pipe each joined through a tool joint. The BHA may include several tools joined to each other such as a bit, a reamer, a flexible component, an RSS, a stabilizer, etc. Additionally, the drill string and the BHA are joined through a connection. In this way, many connections are present downhole in order to join the various components of a downhole system.

Each of these connections, however, can represent a weakness in the downhole system, leading to reliability issues. For example, each connection represents a point where tools are joined together, and these joints are often weaker than the tools themselves. As such, the connection points may have a tendency to fail, for example, before the tools fail. In another example, connections require assembly, which takes time and resources. As such, assembling and disassembling of a drilling tool assembly with an increased number of connections can be time consuming and expensive. In yet another example, connections that require assembly at a drill site may be prone to reliability issues due the location in which it assembled, the personnel assembling the connection, the tools and/or resources available for assembly, etc. Thus, connections that can arrive at the drill site pre-assembled may be more reliable than on-site connections due to the connection being assembled, for example, in a factory with better machinery and/or tools, better skilled labor, the ability to use different and/or more sophisticated connection methods, etc. In this way, more connections required to be assembled at a drill site may result in increased reliability issues and increased use of resources associated with the downhole system.

In addition to facilitating an overall shorter BHA, the flexible downhole component 611-1 may provide reliability benefits by using less connections than the flexible assembly 670 shown in FIG. 6-2 (or similar assembly). For example, the flexible downhole component 611-1 may be formed as one integral body. Accordingly, the flexible downhole component 611-1 with one or both of the upper damping component 612-1 and the lower damping component 612-2 included, may be implemented in a downhole system without adding any additional connections compared to a conventional flexible downhole component. In contrast, the assembly in FIG. 6-2 (or similar assemblies) requires at least one additional connection for each of the damping tools 622. In this way, the flexible downhole component 611-1 may provide reliability benefits and/or cost savings, for example, over conventional and/or alternative techniques.

Figures 1, 7:
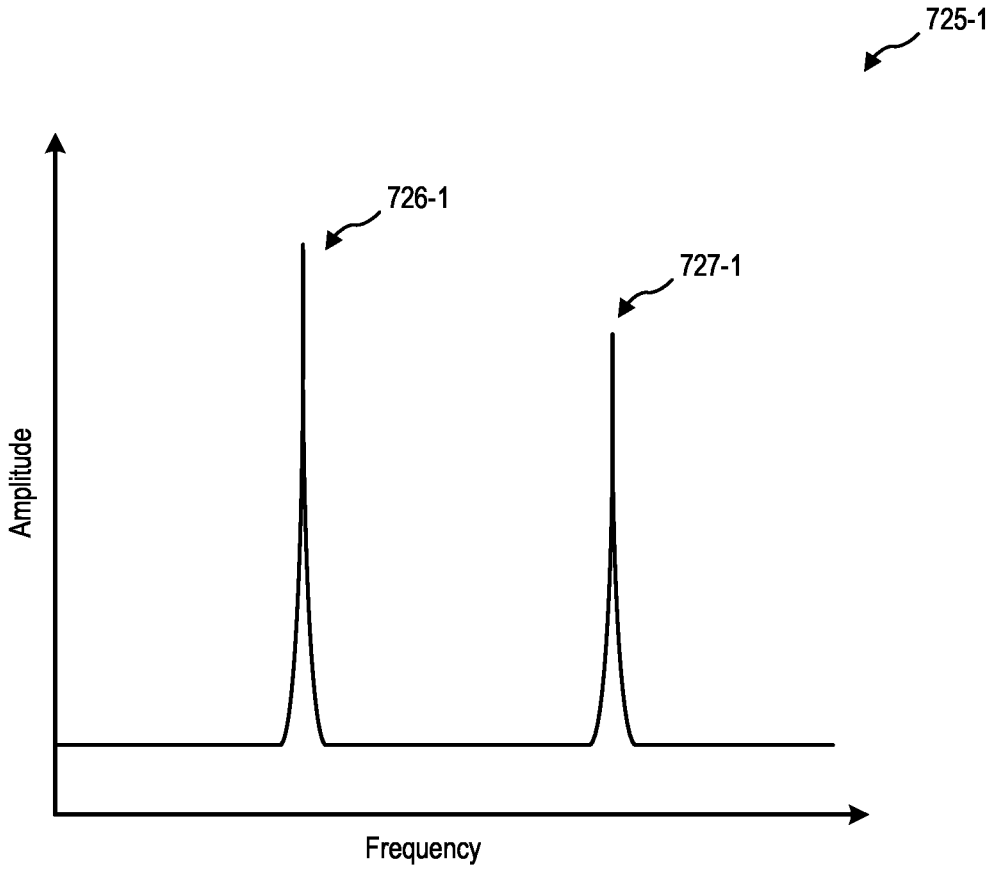
Figures 2, 7:
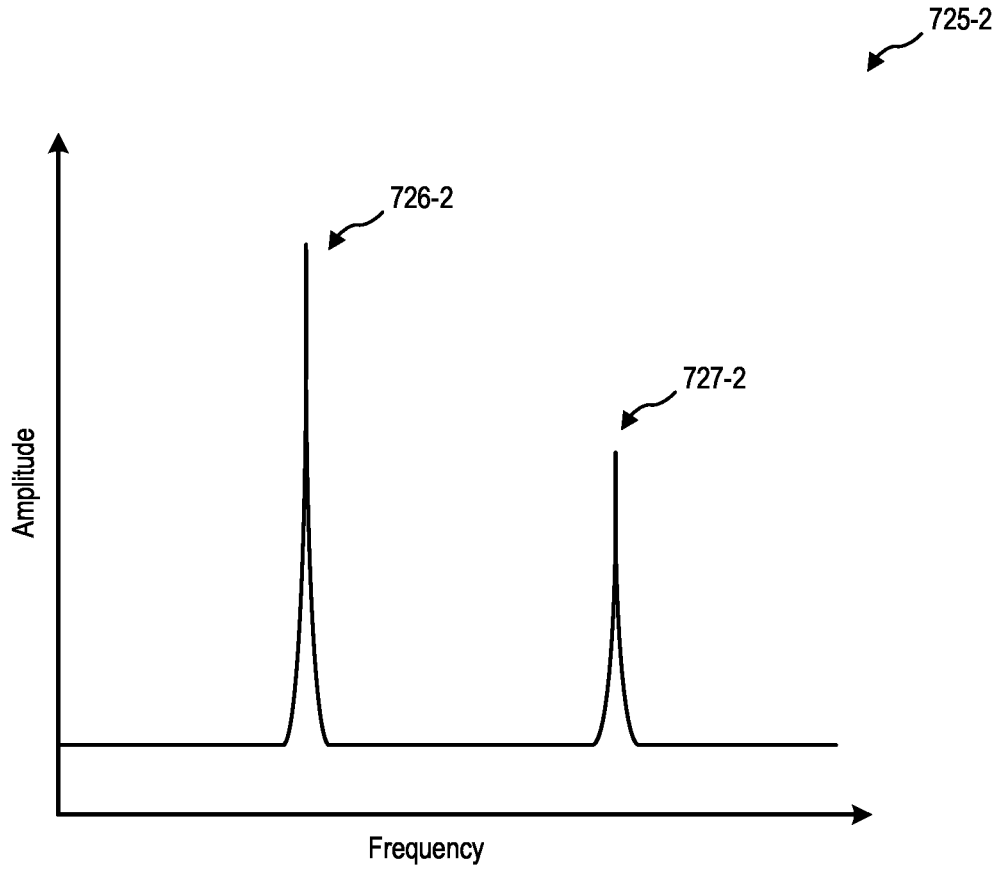
Figures 3, 7:
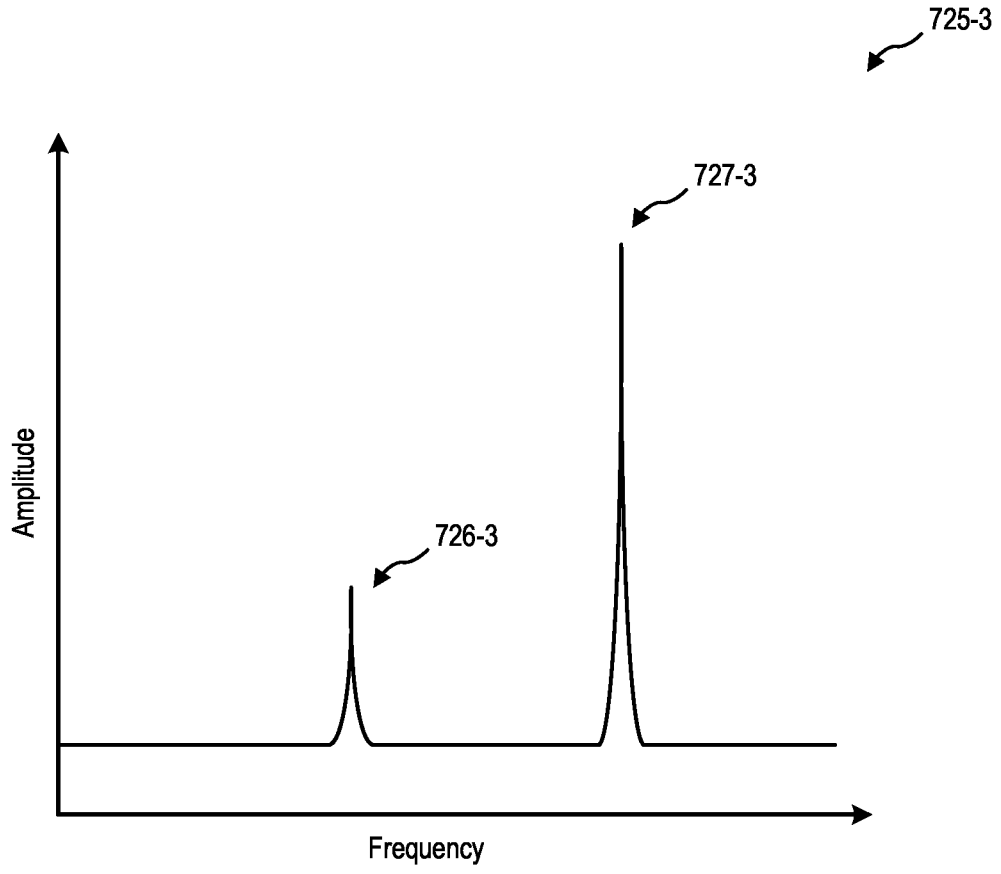
Figures 4, 7:
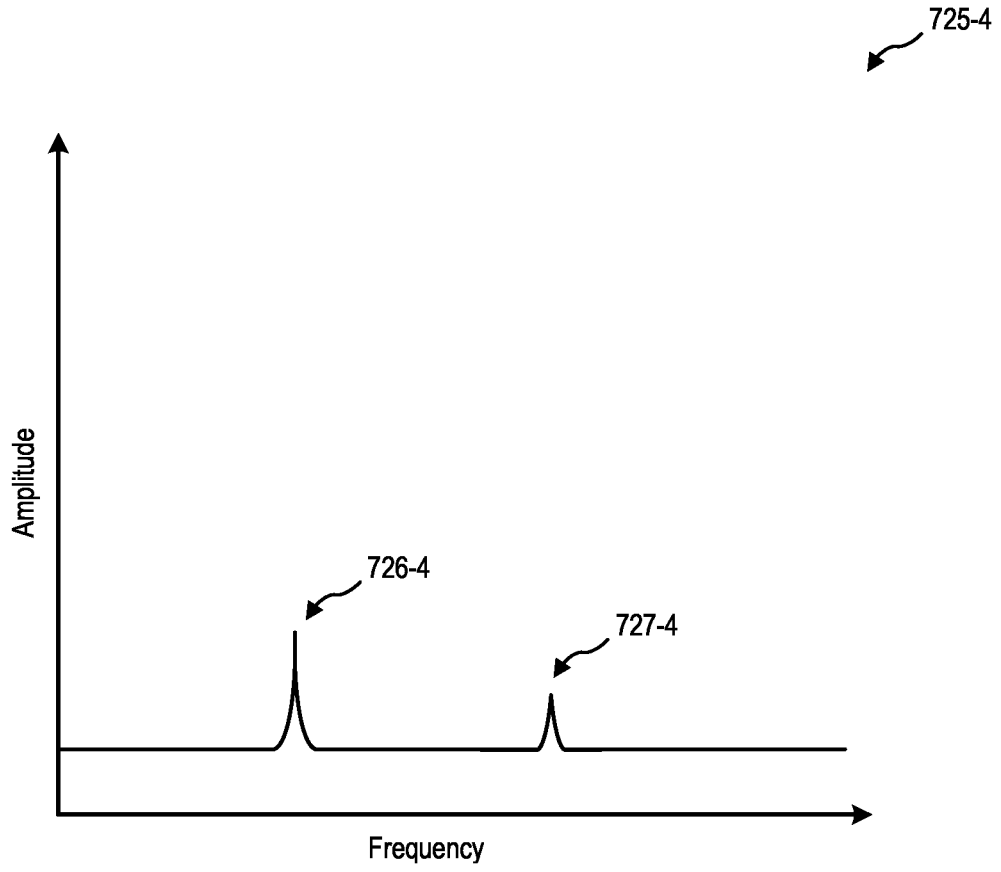

As discussed herein, rotation of a drilling tool assembly may (at least partially) cause oscillations (e.g., HFTO) in the drilling tool assembly, which can have various adverse effects on an operation, wear, productivity, longevity, etc. of a downhole system. FIGS. 7-1 through 7-4 illustrate example vibration data 725 corresponding to vibrations in a drilling tool assembly, according to at least one embodiment of the present disclosure. The various examples of vibration data 725 may include and/or may represent a frequency and/or an amplitude of the vibrations. The vibrations may be HFTO and may be located, exhibited, or detected at a BHA. The BHA may include a flexible component for facilitating a dogleg, and the vibrations may be (at least partly) due to or associated with the flexible component, as described herein. HFTO may typically be vibrations of 40 Hz to 500 Hz, but the techniques described herein may apply to any other vibrations.

FIG. 7-1 illustrates example vibration data 725-1. Vibration data 725-1 may correspond to vibrations in a drilling tool assembly that has not implemented damping means such as the (e.g., torsional) damping components described herein. The vibration data 725-1 may be vibrations measurements taken at or corresponding to a specific location in a drilling tool assembly. The vibration data 725-1 may exhibit one or more patterns or modes in the vibrations. For example, a vibration mode may correspond to an instance in the vibration at or exceeding a threshold frequency, an instance in the vibration at or exceeding a threshold amplitude, any other distinguishable feature in the vibration, and combinations thereof. In some cases, a vibration mode may correspond to a natural and/or resonant frequency of one or more components of the drilling tool assembly (or an entirety of the drilling tool assembly). For example, a mode may indicate vibrations that are more severe (e.g., have higher peak amplitudes) at frequencies corresponding to natural and/or resonant frequencies. The natural frequencies of one or more downhole components (or combinations of components) may at least in part be based on (or affected by) a mass, elasticity, material, length, or engagement with the formation of the component, or any other factor (and combinations thereof). Thus, one or more modes of the vibrations may be determined and/or changed based on these properties.

The vibration data 725-1 may include a first mode 726-1 and a second mode 727-1. The first mode 726-1 and the second mode 727-1 may each correspond to a specific frequency or range of frequencies. The first mode 726-1 and the second mode 727-2 may correspond to the same frequency, or one mode may correspond to a higher frequency than the other mode. The first mode 726-1 and the second mode 727-1 may each represent one or more peaks or spikes in an amplitude of the vibrations at a given frequency or range of frequencies. The amplitude of the first mode 726-1 and the second mode 727-1 may be the same or they may be different. In this way, the first mode 726-1 and the second mode 727-1 may each correspond to a portion of the vibrations that is at or exceeds a threshold severity.

The amplitude of vibrations such as HFTO may typically not be uniform along a length of a downhole tool, BHA, or drilling tool assembly. For example, in some embodiments, the first mode 726-1 and/or the second mode 726-2 may indicate a longitudinal location of one or more increased or peak amplitudes of vibrations. In some embodiments, modes and/or increased vibration amplitudes may be present at a midpoint, ¼ point, ¾ point, or any other point (and combinations thereof) of a downhole tool, BHA, or drilling tool assembly. In some embodiments, vibrations modes may be present at or near a flexible downhole component.

In some situations, increased vibration amplitudes may cause or indicate damage, reduce effectiveness, increase fatigue, wear, etc. of one or more downhole components. It may therefore be advantageous to mitigate or eliminate these identified vibration modes. In some embodiments, one or more damping components may be positioned at or near the longitudinal location of a known or detected vibration mode. This may help to reduce that vibration mode and/or may reduce one or more additional vibrations modes at other locations. For example, a vibration mode at a midpoint may be associated with a maximum or peak amplitude. One or more damping components may accordingly be positioning to reduce this midpoint mode, and may also reduce one or more additional modes, such as modes at a ¼ point or a ¾ point. Similarly, positioning one or more damping components to reduce a lesser vibration amplitude such as at a ¼ or ¾ point may reduce the amplitude at that associated location and may also reduce an amplitude at one or more additional locations, such as at a midpoint. As mentioned above, in some embodiments the vibrations modes (e.g., midpoint, ¼ point, ¾ point, etc.) may be present at a flexible downhole component such at that described herein. Thus, including one or more damping components as part of the flexible downhole component may facilitate reducing increased vibration amplitudes at the flexible downhole component as well as at other locations wherein increased and/or peak vibration amplitudes occur.

As discussed herein, one or more damping components (such as the damping components described in connection with FIGS. 2 through 6-2) may be implemented in a downhole system in order to mitigate, reduce, combat, adjust, or eliminate vibrations such as HFTO. FIG. 7-2 illustrates example vibration data 725-2. Vibration data 725-2 may correspond to vibrations in a drilling tool assembly in connection with implementing one (e.g., torsional) damping component as described herein. The vibration data 725-2 may be compared to vibration data 725-1 to illustrate the damping effects of implementing one damping component. The damping component implemented in connection with vibration data 725-2 may be implemented as part of a flexible downhole component, as described herein. The damping component may be included in the flexible downhole component on an uphole portion or on a downhole portion of the flexible downhole component.

Similar to vibration data 725-1, vibration data 725-2 may include or exhibit a first mode 726-2 and a second mode 727-2. The first mode 726-2 and the second mode 727-2 may correspond to distinguishable amplitudes or peaks in the vibration data 725-2 at specific frequencies or ranges of frequencies. In some embodiments, the first mode 726-2 and/or the second mode 727-2 each correspond to one or more natural or resonant frequencies of the drilling tool assembly and/or BHA. In some embodiments, a single damping component (e.g., uphole or downhole in relation to the flexible downhole component) may be configured to reduce in amplitude one of the vibration modes. That is, damping features of the single damping component may be sized and arranged to target a reduction of the second mode 727-2. For example, as shown, the amplitude of the second mode 727-2 may be reduced to a substantial degree, or in some cases even substantially eliminated. The amplitude of the first mode 726-2 may not be changed to a substantial degree, or in some cases may remain unchanged. In some embodiments, the single damping component causes the frequency (or range of frequencies) of each of the first mode 726-2 and/or the second mode 727-2 to either increase or decrease. This may be in addition to, or as an alternative to, the reduction in amplitude of the second mode 727-2. In this way, implementation of a single damping component may help to change and/or mitigate one mode of HFTO, but another mode of HFTO may still be present to a significant degree. Put another way, the damping component associated with vibration data 725-2 may have a damping profile for damping one mode (or one frequency) of HFTO. The damping profile may be selected and/or determined based on a specific mode. For example, the damping component may be configured and positioned at a specific location in order to provide damping for a specific mode of vibration. In this way, the adverse effects of HFTO may only be partially mitigated by implementing a single damping component.

FIG. 7-3 illustrates example vibration data 725-3. Vibration data 725-3 may correspond to vibrations in a drilling tool assembly in connection with implementing one (e.g., torsional) damping component as described herein. The vibration data 725-3 may be compared to vibration data 725-1 to illustrate the damping effects of implementing one damping component. The damping component implemented in connection with vibration data 725-3 may be implemented as part of a flexible downhole component, as described herein. The damping component may be included in the flexible downhole component on an uphole portion or on a downhole portion of the flexible downhole component. In some embodiments, the damping component is included at an opposite location of the flexible downhole component to the damping component described in connection with vibration data 725-2 of FIG. 7-2.

Similar to vibration data 725-1, vibration data 725-3 may include or exhibit a first mode 726-3 and a second mode 727-3. The first mode 726-3 and the second mode 727-3 may correspond to distinguishable amplitudes or peaks in the vibration data 725-3 at specific frequencies or ranges of frequencies. In some embodiments, the first mode 726-3 and/or the second mode 727-3 each correspond to one or more natural or resonant frequencies of the drilling tool assembly and/or BHA. In some embodiments, a single damping component (e.g., uphole or downhole in relation to the flexible downhole component) may be configured to reduce in amplitude one of the vibration modes. That is, damping features of the single damping component may be sized and arranged to target a reduction of the first damping mode 726-3. For example, as shown, the amplitude of the first mode 726-3 may be reduced to a substantial degree, or in some cases even substantially eliminated. The amplitude of the second mode 727-3 may not be changed to a substantial degree, or in some cases may remain unchanged. In some embodiments, the single damping component causes the frequency (or range of frequencies) of each of the first mode 726-3 and/or the second mode 727-2 to either increase or decrease. This may be in addition to, or as an alternative to, the reduction in amplitude of the first mode 726-3. In this way, implementation of a single damping component may help to change and/or mitigate one mode of HFTO, but another mode of HFTO may still be present to a significant degree. Put another way, the damping component associated with vibration data 725-3 may have a damping profile for damping one mode (or one frequency) of HFTO. The damping profile may be selected and/or determined based on a specific mode. For example, the damping component may be configured and positioned at a specific location in order to provide damping for a specific mode of vibration. The damping component associated with vibration data 725-3 may have the same damping profile or may be a different damping profile than the damping component associated with vibration data 725-2. In this way, the adverse effects of HFTO may only be partially mitigated by implementing a single damping component.

FIG. 7-4 illustrates example vibration data 725-4. Vibration data 725-4 may correspond to vibrations in a drilling tool assembly in connection with implementing two damping components as described herein. In other words, the vibration data 725-4 may be compared to vibration data 725-1 to illustrate the damping effects of implementing two damping components. The two damping components implemented in connection with vibration data 725-4 may be implemented as part of a flexible downhole component, as described herein. The damping components may be included in the flexible downhole component on both an uphole portion and a downhole portion of the flexible downhole component, as described herein.

Similar to vibration data 725-1, vibration data 725-4 may include or exhibit a first mode 726-4 and a second mode 727-3. The first mode 726-4 and the second mode 727-4 may correspond to distinguishable amplitudes or peaks in the vibration data 725-4 at specific frequencies or ranges of frequencies. In some embodiments, the first mode 726-4 and/or the second mode 727-4 each correspond to one or more natural or resonant frequencies of the drilling tool assembly and/or BHA. In some embodiments, two damping components (e.g., both uphole and downhole in relation to the flexible downhole component as described herein) may be configured to reduce in amplitude both of the vibration modes. That is, damping features of the two damping components may be sized and arranged to target reductions of the first mode 726-4 and the second mode 727-4. For example, as shown, the amplitude of each of the first mode 726-4 and the second mode 727-4 may be reduced to a substantial degree, or in some cases even substantially eliminated. This reduction in amplitude may be in contrast to the vibration data 725-1 for a flexible downhole component which does not implement the damping components as described herein. In some embodiments, the two damping components cause the frequencies (or ranges or frequencies) of each of the first mode 726-4 and the second mode 727-4 to either increase or decrease. This may be in addition to, or as an alternative to, the reduction in amplitude of the first mode 726-4 and/or the second mode 727-4.

The amplitude reduction of the first mode 726-4 may be in a range having an upper value, a lower value, or upper and lower values including any of 5%, 10%, 10%, 20%, 25%, 30%, 40%, 50%, 60%, 70%, 80%, 90%, 100%, or any value therebetween. For example, the amplitude of the first mode 726-4 may be reduced by less than 100%. In another example, the amplitude of the first mode 726-4 may be reduced by more than 5%. In yet another example, the amplitude of the first mode 726-4 may be reduced by between 5% and 100%. In some embodiments, it is critical that the amplitude of the first mode 726-4 be reduced by at least 30% in order to substantially mitigate the effects of HFTO on the downhole system as described herein. In some embodiments, reducing the amplitude by as little as 10% may be beneficial when considering the reduction in fatigue over a downhole tool's working life.

The amplitude reduction of the second mode 727-4 may be in a range having an upper value, a lower value, or upper and lower values including any of 5%, 10%, 15%, 20%, 25%, 30%, 40%, 50%, 60%, 70%, 80%, 90%, 100%, or any value therebetween. For example, the amplitude of the second mode 727-4 may be reduced by less than 100%. In another example, the amplitude of the second mode 727-4 may be reduced by more than 5%. In yet another example, the amplitude of the second mode 727-4 may be reduced by between 5% and 100%. In some embodiments, it is critical that the amplitude of the second mode 727-4 be reduced by at least 30% in order to mitigate the effects of HFTO on the downhole system as described herein. In some embodiments, reducing the amplitude by as little as 10% may be beneficial when considering the reduction in fatigue over a downhole tool's working life.

As shown in FIGS. 7-2 through 7-4, each damping component may have a damping profile for damping a particular mode (and/or frequency) of vibrations (e.g., HFTO), but not necessarily both modes. By implementing two damping components, as described herein, the combined damping profiles of each of the damping components may target both modes of vibrations and thereby help to reduce the severity of both modes of HFTO. In some embodiments, the two damping components damp one or more resonant and/or natural frequencies associated with each of the first mode 726-4 and/or the second mode 727-4. In some embodiments, the two damping components damp one or more increased vibration amplitudes at locations other than those directly associated with the first mode 726-4 and/or the second mode 727-4. For example, the first mode 726-4 and the second mode 727-4 may be present at or near a flexible downhole component, and the damping components may accordingly be implemented at the flexible downhole component. In addition to damping the first mode 726-4 and the second mode 727-4 at the flexible downhole component, the damping components may damp one or more increased vibrations amplitudes at other locations of a downhole tool, BHA, or drilling tool assembly. In this way, the adverse effects of HFTO on the downhole system may be mitigated more effectively and/or more completely.

Figure 8:
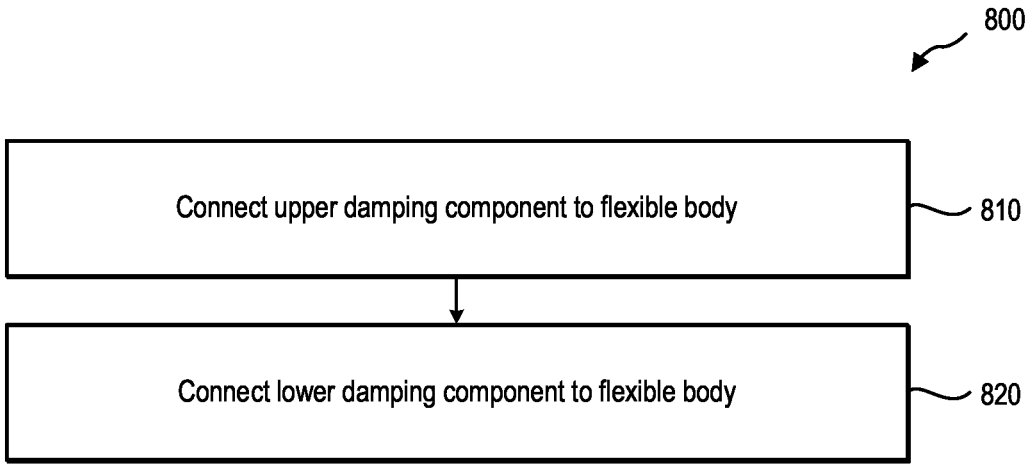
FIG. 8 illustrates a flow diagram for a method or a series of acts for assembling a flexible downhole component as described herein, according to at least one embodiment of the present disclosure.

FIG. 8 illustrates a flow diagram for a method 800 or a series of acts for assembling a flexible downhole component as described herein, according to at least one embodiment of the present disclosure. While FIG. 8 illustrates acts according to one embodiment, alternative embodiments may omit, add to, reorder, or modify any of the acts shown in FIG. 8.

The method 800 may include an act 810 of connecting an upper damping component to a flexible body. The upper damping component may be connected on an uphole end of the flexible body. The upper damping component may be configured to mitigate a first mode of HFTO of the flexible downhole component. The flexible body may include an upper connection for connecting the flexible downhole component to a first downhole tool. The upper damping component may be connected to the flexible body at the upper connection. The upper damping component may be connected to the flexible body by integrally forming the upper damping component with the flexible body. The flexible body may be configured to bend throughout a rotation of the flexible downhole component to facilitate a dogleg of a downhole tool connected to the flexible downhole component. In some embodiments, the upper damping component is connected to the flexible body without increasing a length of a BHA that includes the flexible downhole component.

The method 800 may include an act 820 of connecting a lower damping component to the flexible body. The lower damping component may be connected to a downhole end of the flexible body. The lower damping component may be configured to mitigate a second mode of HFTO of the flexible downhole component. The flexible body may include a lower connection for connecting the flexible downhole component to a second downhole tool. The lower damping component may be connected to the flexible body at the lower connection. The lower damping component may be connected to the flexible body by integrally forming the lower damping component with the flexible body. In some embodiments, the lower damping component is connected to the flexible body without increasing the length of the BHA that includes the flexible downhole component.

INDUSTRIAL APPLICABILITY

The present disclosure includes a number of practice application shaving features described herein that provide benefits and/or solve problems associated with damping vibrations such as high frequency torsional oscillations (HFTO) in downhole system. Some example benefits are discussed herein in connection with various features and functionalities provided by a damping system. It will be appreciated that the benefits explicitly discussed in connection with one or more embodiments described herein are provided by way of example and are not intended to be an exhaustive list of all possible benefits of the damping systems, methods, and devices described herein and are further not intended to limit the scope of the claims.

For example, as discussed herein, downhole systems may implement one or more rotating components. The rotations of these components may cause and/or result in vibrations, oscillations, and/or periodic movement (such as HFTO) of one or more downhole components of the drilling system. In some embodiments, these vibrations can cause damage, wear, fatigue, or failure of one or more downhole components. In some embodiments, these vibrations can adversely affect an efficiency, production, or effectiveness of one or more downhole tools. The damping components described herein may be included, for example, as a part of one or more downhole tools in order to mitigate the vibrations. For example, the damping components may reduce, eliminate, or change a frequency, amplitude, or location of the vibrations. This damping of the vibrations may help to reduce or even eliminate the adverse effects of the vibrations on the downhole system. In this way, the damping components may facilitate reducing damage, increasing the lifetime of, and/or increasing an effectiveness and/or productivity of the downhole system.

In addition to mitigating unwanted vibrations, the damping components described herein may do so in a way that does not adversely affect the steering and/or directing of one or more downhole components, such as the BHA. In many cases, a downhole system includes a flexible component (e.g., in the BHA) that may bend in order to facilitate directing the BHA and the wellbore at an angle. The degree to which a BHA may be directed, or the dogleg that may be achieved, is directly affected by the overall length of the BHA. For example, a shorter BHA may achieve a tighter dogleg than a longer BHA. Thus, it may be critical to ensure the BHA remains within a threshold length in order to achieve the necessary steering angles. As discussed above, in some situations a downhole system may experience vibrations, and damping components may be implemented to combat these vibrations. In many cases, these vibrations may be associated with (or may be most severe at) the flexible component. Thus, it may be desirable to implement the damping components at or in conjunction with the flexible component. The flexible downhole component described herein may include one or more damping components for damping HFTO, and may do so without increasing the length of the BHA past a threshold length. In some cases, the flexible downhole component may not increase the length of the BHA at all. In contrast, conventional or alternative methods may implement damping components that result in a longer overall BHA than is achieved when implementing the flexible downhole component described herein. In this way, the flexible downhole component may provide (e.g., torsional) damping to an attached BHA without negatively impacting the ability to steer the BHA.

Additionally, downhole systems implement a multitude of downhole components generally connected end to end through tool connections. These connections represent weaknesses in the downhole system as the connections are often weaker than the downhole components themselves and/or more prone to wear (e.g., leakage). Connections also require assembly/disassembly which can be time-consuming and expensive. Thus, it may be advantageous to reduce the number of connections in the downhole system where possible. The flexible downhole component described herein may include and/or implement one or more damping components in many cases without any additionally and/or unnecessary connections. For example, the damping components may be integral to and/or attached within (e.g., a body of) the flexible downhole component. This may be in contrast to, for example, connected one or more damping components to one or more ends of the flexible downhole component, and further connecting those damping components to the other downhole tools. In this way, the flexible downhole component may provide increased reliability and/or cost savings by reducing the number of connections in the downhole system.

The following non-limiting examples are illustrative of the various permutations contemplated herein.

A1. A flexible downhole component, comprising:
- an upper connection for connecting the flexible downhole component to a first downhole tool;
- a lower connection for connecting the flexible downhole component to a second downhole tool;
- a flexible body disposed between the upper connection and the lower connection;
- an upper damping component configured to damp torsional oscillations; and
- a lower damping component configured to damp torsional oscillations.

A2. The flexible downhole component of A1, wherein the upper damping component is located at the upper connection and the lower damping component is located at the lower connection.

A3. The flexible downhole component of A1 or A2, wherein the upper damping component and the lower damping component are each configured to damp high-frequency torsional oscillations between 150 Hz and 300 Hz.

A4. The flexible downhole component of any of A1-A3, wherein the flexible body has a flexible body diameter, the upper connection has an upper connection diameter, and the lower connection has a lower connection diameter, and wherein the flexible body diameter is less than the upper connection diameter and the lower connection diameter.

A5. The flexible downhole component of any of A1-A4, wherein the flexible body has a flexible body stiffness, the upper connection has an upper connection stiffness, and the lower connection has a lower connection stiffness, and wherein the flexible body stiffness is less than the upper connection stiffness and the lower connection stiffness.

A6. The flexible downhole component of any of A1-A5, wherein the upper damping component includes an upper housing for housing one or more upper inertial damping elements, the lower damping component includes a lower housing for housing one or more lower inertial damping elements, and wherein the upper housing, the lower housing, and the flexible body are integrally formed.

A7. The flexible downhole component of any of A1-A6, wherein a length of a downhole assembly including the flexible downhole component is no greater than 20 feet.

A8. The flexible downhole component of any of A1-A7, wherein the upper damping component has a first damping profile corresponding with a first mode of high frequency torsional oscillations (HFTO) and the lower damping component has a second damping profile corresponding with a second mode of HFTO.

A9. The flexible downhole component of A8, wherein the first mode of HFTO corresponds to a first resonant frequency of a downhole system implementing the flexible downhole component.

A10. The flexible downhole component of A8 or A9, wherein the second mode of HFTO corresponds to a second resonant frequency of a downhole system implementing the flexible downhole component.

A11. The flexible downhole component of any of A1-A10, wherein the upper damping component and the lower damping component each include an inertial element at least partially suspended in fluid for damping the torsional oscillations.

B1. A flexible downhole system, comprising:
- a flexible body; and
- a first torsional damping component integrally joined to the flexible body, wherein the first torsional damping component includes inertial damping elements.

B2. The system of B1, comprising a second torsional damping component joined to the flexible body opposite the first torsional damping component.

B3. The system of B1 or B2, wherein:
- the first torsional damping component is connected to an uphole end of the flexible body and has a first damping profile for damping a first frequency of high frequency torsional oscillations (HFTO) of the flexible downhole system; and
- the second torsional damping component is connected to a downhole end of the flexible body and has a second damping profile for damping a second frequency of HFTO of the flexible downhole system.

B4. The system of B3, wherein the first frequency and the second frequency are the same.

B5. The system of B3, wherein the first frequency is greater than the second frequency.

B6. The system of B3, wherein the second frequency is greater than the first frequency.

B7. The system of any of B3-B6, wherein the first frequency corresponds to a first resonant frequency of the flexible downhole system.

B8. The system of any of B3-B7, wherein the second frequency corresponds to a second resonant frequency of the flexible downhole system.

B9. The system of any of B3-B8, wherein the first frequency is greater than the second frequency.

B10. The system of any of B3-B8, wherein the second frequency is greater than the first frequency.

B11. The system of any of B3-B10, wherein the first torsional damping component damps the first frequency by at least 30% and wherein the second torsional damping component damps the second frequency by at least 30%.

B12. The system of any of B3-B11, wherein the second torsional damping component is integrally joined to the flexible body.

C1. A method of assembling a flexible downhole component, comprising:
- connecting an upper damping component to an uphole end of a flexible body, the upper damping component being configured to mitigate a first mode of high frequency torsional oscillations (HFTO) of the flexible downhole component, and wherein the flexible body is configured to bend throughout a rotation of the flexible downhole component to facilitate a dogleg of a downhole tool connected to the flexible downhole component; and
- connecting a lower damping component to a downhole end of the flexible body, the lower damping component being configured to mitigate a second mode of HFTO of the flexible downhole component.

C2. The method of C1, wherein:

the flexible body includes an upper connection for connecting the flexible downhole component to a first downhole tool, and connecting the upper damping component includes connecting the upper damping component at the upper connection; and the flexible body includes a lower connection for connecting the flexible downhole component to a second downhole tool, and connecting the lower damping component includes connecting the lower damping component at the lower connection.

C3. The method of C1 or C2, further including connecting the upper damping component and the lower damping component without increasing a length of a bottom hole assembly that includes the flexible downhole component.

C4. The method of any of C1-C3, wherein connecting the upper damping component includes integrally forming the upper damping component with the flexible body, and connecting the lower damping component includes integrally forming the lower damping component with the flexible body.

The embodiments of the flexible downhole component have been primarily described with reference to wellbore drilling operations. The flexible downhole component described herein may be used in applications other than the drilling of a wellbore. In other embodiments, the flexible downhole component according to the present disclosure may be used outside a wellbore or other downhole environment used for the exploration or production of natural resources. For instance, the flexible downhole component of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

Various features are described herein in alternative format in order to emphasize that features may be combined in any number of combinations. Each feature should be considered to be combinable with each other feature unless such features are mutually exclusive. The term "or" as used herein is not exclusive unless the contrary is clearly expressed. For instance, having A or B encompasses A alone, B alone, or the combination of A and B. In contrast, having only A or B encompasses A alone or B alone, but not the combination of A or B. Even if not expressly recited in multiple independent form, the description provides support for each claim being combined with each other claim (or any combination of other claims).

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A flexible downhole component, comprising:

an upper connection for connecting the flexible downhole component to a first downhole tool;

a lower connection for connecting the flexible downhole component to a second downhole tool;

a flexible body disposed between the upper connection and the lower connection;

an upper damping component configured to damp torsional oscillations;

a lower damping component configured to damp torsional oscillations; and wherein a downhole assembly length of a downhole assembly including the flexible downhole component is no greater than 20 feet.

2. The flexible downhole component of claim 1, wherein the upper damping component is located at the upper connection and the lower damping component is located at the lower connection.

3. The flexible downhole component of claim 1, wherein the upper damping component and the lower damping component are each configured to damp high-frequency torsional oscillations between 150 Hz and 300 Hz.

4. The flexible downhole component of claim 1, wherein the flexible body has a flexible body diameter, the upper connection has an upper connection diameter, and the lower connection has a lower connection diameter, and wherein the flexible body diameter is less than the upper connection diameter and the lower connection diameter.

5. The flexible downhole component of claim 1, wherein the flexible body has a flexible body stiffness, the upper connection has an upper connection stiffness, and the lower connection has a lower connection stiffness, and wherein the flexible body stiffness is less than the upper connection stiffness and the lower connection stiffness.

6. The flexible downhole component of claim 1, wherein the upper damping component includes an upper housing for housing one or more upper inertial damping elements, the lower damping component includes a lower housing for housing one or more lower inertial damping elements, and wherein the upper housing, the lower housing, and the flexible body are integrally formed.

7. The flexible downhole component of claim 1, wherein the upper damping component has a first damping profile corresponding with a first mode of high frequency torsional oscillations (HFTO) and the lower damping component has a second damping profile corresponding with a second mode of HFTO.

8. The flexible downhole component of claim 1, wherein the upper damping component and the lower damping component each include an inertial element at least partially suspended in a fluid for damping the torsional oscillations.

9. A flexible downhole system, comprising:

a flexible body; and a first torsional damping component integrally joined to the flexible body, wherein the first torsional damping component includes viscous inertial damping elements; and wherein a downhole assembly length of a downhole assembly including the flexible downhole component is no greater than 20 feet.

10. The system of claim 9, comprising a second torsional damping component joined to the flexible body opposite the first torsional damping component.

11. The system of claim 10, wherein:

the first torsional damping component is connected to an uphole end of the flexible body and has a first damping profile for damping a first frequency of high frequency torsional oscillations (HFTO) of the flexible downhole system; and the second torsional damping component is connected to a downhole end of the flexible body and has a second damping profile for damping a second frequency of HFTO of the flexible downhole system.

12. The system of claim 11, wherein the first frequency and the second frequency are the same.

13. The system of claim 11, wherein the first frequency is greater than the second frequency.

14. The system of claim 11, wherein the first torsional damping component damps the first frequency by at least 30% and wherein the second torsional damping component damps the second frequency by at least 30%.

15. The system of claim 9, wherein the second torsional damping component is integrally joined to the flexible body.

16. A method of assembling a flexible downhole component, comprising:

connecting an upper damping component to an uphole end of a flexible body, the upper damping component being configured to mitigate a first mode of high frequency torsional oscillations (HFTO) of the flexible downhole component, and wherein the flexible body is configured to bend throughout a rotation of the flexible downhole component to facilitate a dogleg of a downhole tool connected to the flexible downhole component; and connecting a lower damping component to a downhole end of the flexible body, the lower damping component being configured to mitigate a second mode of HFTO of the flexible downhole component; and utilizing the flexible downhole component in a downhole assembly, wherein the length of a downhole assembly including the flexible downhole component is no greater than 20 feet.

17. The method of claim 16, wherein:

the flexible body includes an upper connection for connecting the flexible downhole component to a first downhole tool, and connecting the upper damping component includes connecting the upper damping component at the upper connection; and the flexible body includes a lower connection for connecting the flexible downhole component to a second downhole tool, and connecting the lower damping component includes connecting the lower damping component at the lower connection.

18. The method of claim 16, further including connecting the upper damping component and the lower damping component without increasing a length of a bottom hole assembly that includes the flexible downhole component.

19. The method of claim 16, wherein connecting the upper damping component includes integrally forming the upper damping component with the flexible body, and connecting the lower damping component includes integrally forming the lower damping component with the flexible body.

* * * * *